US011663978B1

(12) United States Patent
Jang et al.

(10) Patent No.: US 11,663,978 B1
(45) Date of Patent: May 30, 2023

(54) DRIVING CIRCUIT AND DISPLAY INCLUDING THE SAME

(71) Applicant: ADRC. CO. KR, Seoul (KR)

(72) Inventors: Jin Jang, Seoul (KR); Jun Hyuk Cheon, Seoul (KR); Junyeong Kim, Seoul (KR); Suhui Lee, Seoul (KR); Yuanfeng Chen, Seoul (KR); Mohammad Masum Billah, Seoul (KR)

(73) Assignee: ADRC. CO. KR, Seoul (KR)

( * ) Notice: Subject to any disclaimer, the term of this patent is extended or adjusted under 35 U.S.C. 154(b) by 0 days.

(21) Appl. No.: 17/823,945

(22) Filed: Aug. 31, 2022

(30) Foreign Application Priority Data

Mar. 22, 2022 (KR) ..... 10-2022-0035527

(51) Int. Cl.
*G09G 3/3266* (2016.01)

(52) U.S. Cl.
CPC ..... *G09G 3/3266* (2013.01); *G09G 2330/021* (2013.01)

(58) Field of Classification Search
CPC ..... G09G 3/20; G09G 3/3266; G09G 3/3674; G09G 2300/0426; G09G 2300/08; G09G 2310/0243; G09G 2310/0267; G09G 2310/0286; G09G 2310/08; G11C 19/28
See application file for complete search history.

(56) References Cited

FOREIGN PATENT DOCUMENTS

CN 112397008 A * 2/2021 ..... G09G 3/20

OTHER PUBLICATIONS

English translation of CN112397008A (Year: 2021).*
Abidur Rahaman et al., "A High-Gain CMOS Operational Amplifier Using Low-Temperature Poly-Si Oxide TFTs", IEEE Transactions on Electron Devices, vol. 67, No. 2, pp. 524-528, Feb. 2020.
Yuanfeng Chen et al., "In-pixel temperature sensor for high-luminance active matrix micro-light-emitting diode display using low temperature polycrystalline silicon and oxide thin-film-transistors", J. Soc. Inf. Display, vol. 28, No. 6, pp. 528-534, May 2020.
Eunji Song et al., "Low Power Programmable Shift Register With Depletion Mode Oxide TFTs for High Resolution and High Frame Rate AMFPDs", Journal of Display Technology, vol. 10, No. 10, Oct. 2014.
Abu Bakar Siddik et al., "Blue Laser Annealed Sub-Micron Channel P-Type Low Temperature Poly-Si TFT Without Kink Effect for High-Resolution Display", IEEE Electron Device Letters, vol. 42, No. 2, Feb. 2021.

(Continued)

*Primary Examiner* — Nelson M Rosario
(74) *Attorney, Agent, or Firm* — Lex IP Meister, PLLC

(57) ABSTRACT

The present invention relates to a driving circuit including stages for supplying signals. The respective stages may include: a first LTPO transistor including a first transistor that is a low-temperature polycrystalline silicon thin film transistor (LTPS TFT) and a second transistor that is an oxide TFT; and a second LTPO transistor including a third transistor that is an LTPS TFT and a fourth transistor that is an oxide TFT. A first end of the first LTPO transistor may be connected to a gate of the second LTPO transistor, and voltages of signals corresponding to the respective stages from among the signals may be a voltage at a first end of the second LTPO transistor.

17 Claims, 29 Drawing Sheets

(56) References Cited

OTHER PUBLICATIONS

Mohammad Masum Billah et al., "Analysis of Improved Performance Under Negative Bias Illumination Stress of Dual Gate Driving a-IGZO TFT by TCAD Simulation", IEEE Electron Device Letters, vol. 37, No. 6, Jun. 2016.
Junyeong Kim et al., "A Novel Gate Driver Working Under Depletion Mode Oxide TFTs Using Low-Temperature Poly-Si Oxide TFTs", IEEE Electron Device Letters, vol. 42, No. 11, Nov. 2021.
Junyeong Kim et al., "Ultra-Low Power, Emission Gate Driver With Pulse Width Modulation Using Low-Temperature Poly-Si Oxide Thin-Film Transistors", IEEE Electron Device Letters, vol. 43, No. 2, Feb. 2020.

* cited by examiner

DRIVING CIRCUIT AND DISPLAY INCLUDING THE SAME

CROSS-REFERENCE TO RELATED APPLICATION

This application claims priority to and the benefit of Korean Patent Application No. 10-2022-0035527 filed in the Korean Intellectual Property Office on Mar. 22, 2022, the entire contents of which are incorporated herein by reference.

BACKGROUND

(a) Field of the Invention

The present disclosure relates to a driving circuit and a display including the same.

(b) Description of the Related Art

To reduce cost of driver ICs such as a gate driver or a light emitting driver of a display and down-size the display, a driver integrated on an array may be applied to the display. High performance such as high operation rates, high reliability, or low power consumption is needed for the integrated driver.

The a-Si TFT has lower mobility than the poly-Si and the oxide TFT so the a-Si TFT is inappropriate for the high-performance display.

The LTPS TFT has been generally used to the TFT backplane technology for small displays such as mobile displays, and it has high mobility and excellent stability. However, it is difficult to reduce power consumption of the display because of high Off-state currents of the LTPS TFT.

On the contrary, the oxide TFT has a very low Off current but has lower current driving performance than the LTPS TFT so it may cause high power consumption. The oxide TFT is easily operated in the depletion mode having a negative threshold voltage (VTH), which generates a malfunction of the gate driver because of a leakage current path. Many TFTs and capacitors must be used to prevent the leakage current path so it is inappropriate in the use of high-resolution displays. Most of the gate drivers configured with the LTPS or the oxide TFT use the bootstrapping method, and the bootstrapping generates a gate bias stress to the TFT.

The above information disclosed in this Background section is only for enhancement of understanding of the background of the invention, and therefore it may contain information that does not form the prior art that is already known in this country to a person of ordinary skill in the art.

SUMMARY OF THE INVENTION

The present invention has been made in an effort to provide a driving circuit that is appropriate for a high-resolution display.

An embodiment of the present invention provides a driving circuit including a plurality of stages for supplying a plurality of signals, wherein the respective stages include: a first LTPO transistor including a first transistor that is a low-temperature polycrystalline silicon thin film transistor (LTPS TFT) and a second transistor that is an oxide TFT; and a second LTPO transistor including a third transistor that is an LTPS TFT and a fourth transistor that is an oxide TFT. A first end of the first LTPO transistor may be connected to a gate of the second LTPO transistor, and voltages of signals corresponding to the respective stages from among the signals may be a voltage at a first end of the second LTPO transistor.

The respective stages may further include: a fifth transistor operable by a previous signal output from a previous stage of the respective stages; and a sixth transistor operable by a next signal output from a next stage of the respective stages, and the previous signal may be supplied to a gate and a first end of the fifth transistor, the next signal may be supplied to a gate of the sixth transistor, and a second end of the fifth transistor and a first end of the sixth transistor may be connected to a gate of the first LTPO transistor. The previous signal may be supplied to a gate and a first end of the fifth transistor, the next signal may be supplied to a gate of the sixth transistor, and a second end of the fifth transistor and a first end of the sixth transistor may be connected to a gate of the first LTPO transistor.

A first end of the third transistor and a first end of the fourth transistor may be connected to a first end of the second LTPO transistor, and a first voltage may be supplied to a second end of the third transistor, and a clock signal may be supplied to a second end of the fourth transistor.

A first end of the first transistor and a first end of the second transistor may be connected to a first end of the first LTPO transistor, and a second voltage may be supplied to a second end of the first transistor, and a third voltage may be supplied to a second end of the second transistor.

The respective stages further include: a control circuit including a third LTPO transistor including a fifth transistor that is an LTPS TFT and a sixth transistor that is an oxide TFT; and a fourth LTPO transistor including a seventh transistor that is an LTPS TFT and an eighth transistor that is an oxide TFT. A first end of the third LTPO transistor may be connected to a gate of the fourth LTPO transistor, a voltage at a first end of the fourth LTPO may be a voltage of a control signal that is an output of the control circuit, and the first LTPO transistor may be operated according to the control signal.

The control circuit of the respective stages may further include: a ninth transistor operable by a previous control signal output from a control circuit of a previous stage of the respective stages; and a tenth transistor operable by a next control signal output from a control circuit of a next stage of the respective stages. The previous control signal may be supplied to a gate and a first end of the ninth transistor, the next control signal may be supplied to a gate of the tenth transistor, and a second end of the ninth transistor and a first end of the tenth transistor may be connected to a gate of the third LTPO transistor.

A first end of the seventh transistor and a first end of the eighth transistor may be connected to a first end of the fourth LTPO transistor, and a first voltage may be supplied to a second end of the seventh transistor, while a clock signal may be supplied to a second end of the eighth transistor.

A first end of the fifth transistor and a first end of the sixth transistor may be connected to the first end of the third LTPO transistor, and a second voltage may be supplied to a second end of the fifth transistor, while a third voltage may be supplied to a second end of the sixth transistor.

The respective stages may further include: a ninth transistor operable by a corresponding one of a plurality of other signals corresponding to the signals; and a tenth transistor operable by the control signal. The corresponding other signal may be supplied to a gate and a first end of the ninth transistor, the control signal may be supplied to a gate of the tenth transistor, and a second end of the ninth transistor and a first end of the tenth transistor may be connected to a gate of the first LTPO transistor.

A first end of the seventh transistor and a first end of the eighth transistor may be connected to a first end of the second LTPO transistor, and a first voltage may be supplied to a second end of the seventh transistor, while a second voltage may be supplied to a second end of the eighth transistor.

A first end of the fifth transistor and a first end of the sixth transistor may be connected to a first end of the first LTPO transistor, and a third voltage may be supplied to a second end of the fifth transistor, while the second voltage may be supplied to a second end of the sixth transistor.

A gate of the first transistor and a bottom gate of the second transistor may extend from one line, and a top gate of the second transistor may be connected to the bottom gate through a via contact.

A gate of the third transistor and a bottom gate of the fourth transistor may be branched from one line, and a top gate of the second transistor may be connected to the bottom gate through a via contact.

Another embodiment of the present invention provides a display including: a plurality of pixel rows including a plurality of pixels; and a gate driver including a plurality of stages for generating a plurality of gate signals and supplying the same to the pixel rows, wherein the respective stages may include a first LTPO transistor realized with a first transistor that is a low-temperature polycrystalline silicon thin film transistor (LTPS TFT) and a second transistor that is an oxide TFT, the second transistor may be synchronized with an On-pulse of a corresponding previous gate signal and may output a corresponding clock signal as the gate signal, and the first transistor may be synchronized with an On-pulse of a corresponding next gate signal and may output an Off-level gate signal.

The respective stages may further include a second LTPO transistor realized with a third transistor that is an LTPS TFT and a fourth transistor that is an oxide TFT, the third transistor may be synchronized with an On-pulse of the previous gate signal and may turn on the second transistor, and the fourth transistor may be synchronized with an On-pulse of the corresponding next gate signal and may turn on the first transistor.

The display may further include a light emitting driver including a plurality of light emitting stages for generating a plurality of light emitting signals and supplying the same to the pixel rows, wherein the respective light emitting stages may include a second LTPO transistor realized with a third transistor that is an LTPS TFT and a fourth transistor that is an oxide TFT, the fourth transistor may be synchronized with an On-pulse of a corresponding gate signal and may output an On-level light emitting signal, and the third transistor may be synchronized with an On-pulse of a light emitting control signal and may output an Off-level light emitting signal.

The respective light emitting stages may further include a third LTPO transistor realized with a fifth transistor that is an LTPS TFT and a sixth transistor that is an oxide TFT, the fifth transistor may be synchronized with an On-pulse of the corresponding gate signal and may turn on the fourth transistor, and the sixth transistor may be synchronized with an On-pulse of the light emitting control signal and may turn on the third transistor.

The respective light emitting stages may further include: a light emitting control circuit for generating the light emitting control signal, the light emitting control circuit may include a fourth LTPO transistor including a fifth transistor that is an LTPS TFT and a sixth transistor that is an oxide TFT; and a fifth LTPO transistor including a seventh transistor that is an LTPS TFT and an eighth transistor that is an oxide TFT, and a first end of the fourth LTPO transistor may be connected to a gate of the fifth LTPO transistor, while a voltage at a first end of the fifth LTPO may be a voltage of the control signal.

The present invention provides the driving circuit that is appropriate for the high-resolution display.

DETAILED DESCRIPTION OF THE EMBODIMENTS

Figure 1:
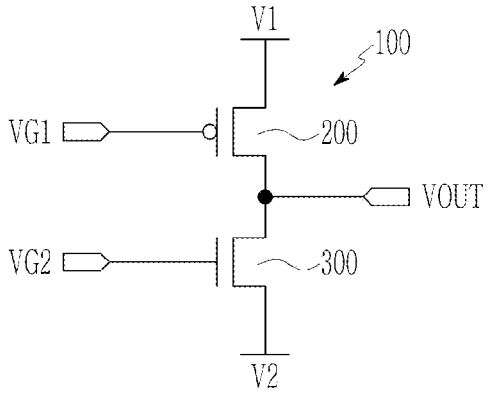
FIG. 1 shows a circuit diagram of a complementary transistor according to an embodiment.

Embodiments disclosed in the present specification will be described in detail with reference to the accompanying drawings. In the present specification, the same or similar components will be denoted by the same or similar reference numerals, and an overlapped description thereof will be omitted.

In describing embodiments of the present specification, when it is determined that a detailed description of the well-known art associated with the present invention may obscure the gist of the present invention, it will be omitted. The accompanying drawings are provided only in order to allow embodiments disclosed in the present specification to be easily understood and are not to be interpreted as limiting the spirit disclosed in the present specification, and it is to be understood that the present invention includes all modifications, equivalents, and substitutions without departing from the scope and spirit of the present invention.

Terms including ordinal numbers such as first, second, and the like will be used only to describe various components, and are not interpreted as limiting these components. The terms are only used to differentiate one component from other components.

It is to be understood that when one component is referred to as being "connected" or "coupled" to another component, it may be connected or coupled directly to another component or be connected or coupled to another component with the other component intervening therebetween. On the other hand, it is to be understood that when one component is referred to as being "connected or coupled directly" to another component, it may be connected or coupled to another component without the other component intervening therebetween.

It is to be understood that terms such as "including," "having," etc. are intended to indicate the existence of features, numbers, steps, actions, components, parts, or combinations thereof disclosed in the specification, and are not intended to preclude the possibility that one or more other features, numbers, steps, actions, components, parts, or combinations thereof may exist or may be added.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

A complementary transistor according to an embodiment will now be described.

FIG. 1 shows a circuit diagram of a complementary transistor according to an embodiment.

Figure 2:
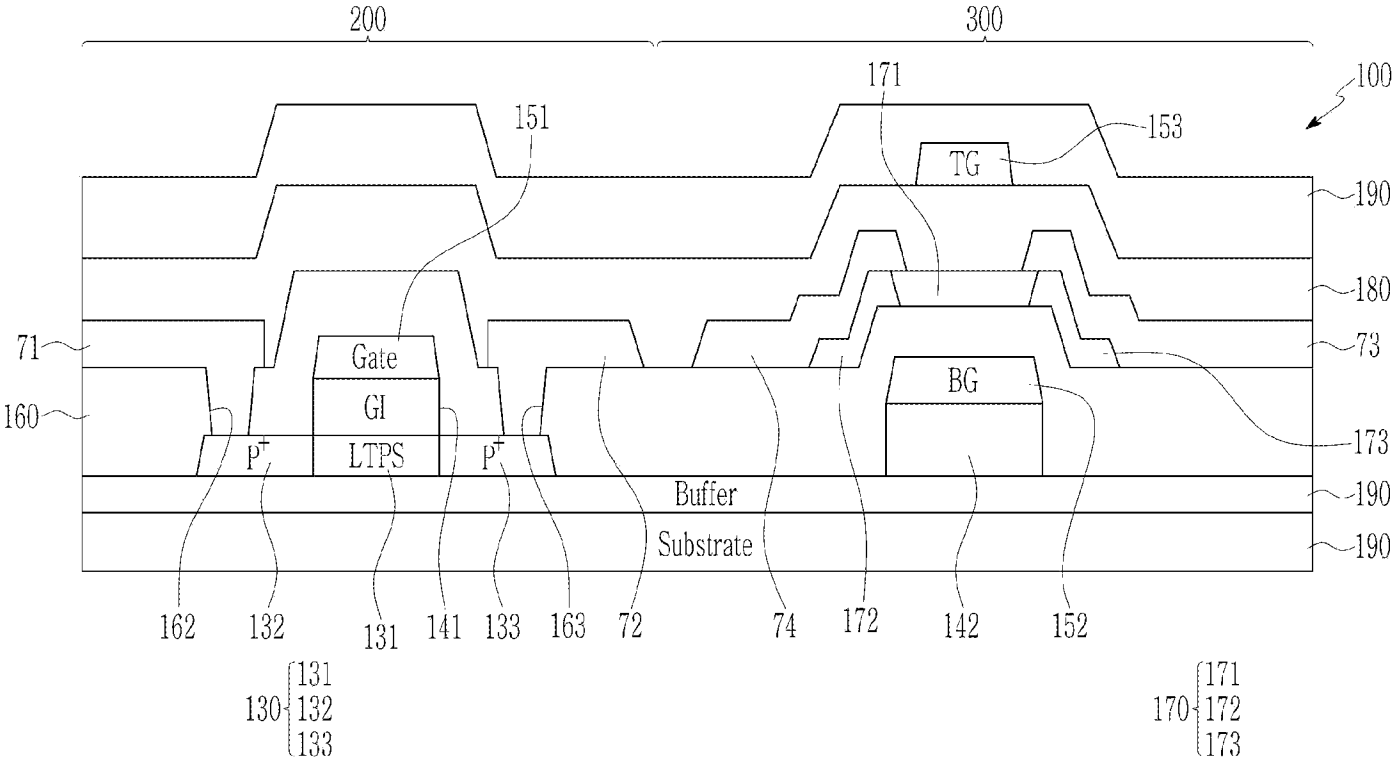
FIG. 2 shows a cross-sectional view of a structure of a complementary transistor according to an embodiment.

FIG. 2 shows a cross-sectional view of a structure of a complementary transistor according to an embodiment.

The complementary transistor 100 includes a first transistor 200 and a second transistor 300.

A voltage V1 is supplied to a source of the first transistor 200, a voltage V2 is supplied to a source of the second transistor 200, and a drain of the first transistor 200 is connected to a drain of the second transistor 200. A node where the two drains are connected to each other may be an output end of the transistor 100. A gate voltage VG1 is supplied to a gate of the first transistor 200 to thus control conduction of the first transistor 200, and a gate voltage VG2 is supplied to a gate of the second transistor 300 to thus control conduction of the second transistor 300.

When the gates of the first transistor 200 and the second transistor 300 are connected to each other, the transistor 100 may be operated as an inverter. That is, one of the first transistor 200 and the second transistor 300 is turned on and the other is turned off by the gate voltage VG1 or VG2, so one of the voltage V1 and the voltage V2 is output as an output voltage VOUT.

The first transistor 200 may be realized with a low-temperature polycrystalline silicon and oxide thin-film transistor LTPO TFT. The transistor 100 may be a self-aligned coplanar p-type low-temperature polycrystalline silicon (LTPS) TFT. The second transistor 300 may be realized with an oxide TFT. For example, the second transistor 300 may be realized with an amorphous-indium-gallium-zinc-oxide (a-IGZO) TFT, an example of the oxide TFT. However, the example of the first and second transistors is given to describe an embodiment, and the present invention is not limited thereto.

Blue laser annealing (BLA) may be used in a process for crystallizing a-Si of the first transistor 200. High mobility caused by a grain size that is greater than that of excimer laser annealing (ELA) may be provided. The second transistor 300 may be a dual gate (DG) n-type TFT. The second transistor 300 may be formed by a back channel etching (BCE). A top gate (TG) and a bottom gate (BG) of the second transistor 300 are electrically connected to each other so an On state current of the second transistor 300 may be high and a threshold voltage may be 0 V which is uniform. A detailed process for manufacturing the first and second transistors 200 and 300 may refer to two known theses given below. No detailed description on the manufacturing process will be provided. That the second transistor 300 has a dual gate structure is an example for describing an embodiment, and the second transistor 300 according to the present invention may be realized with the oxide TFT with a single gate structure.

1) A. Rahaman, H. Jeong and J. Jang, "A High-Gain CMOS Operational Amplifier Using Low-Temperature Poly-Si Oxide TFTs," IEEE Transactions on Electron Devices, vol. 67, no. 2, pp. 524-528, February 2020.

2) Y. Chen, S. Lee, H. Kim, J. Lee, D. Geng, and J. Jang, "In-pixel temperature sensor for high-luminance active matrix micro-light-emitting diode display using low-temperature polycrystalline silicon and oxide thin-film-transistors," J. Soc. Inf. Display, vol. 28, no. 6, pp. 528-534, May 2020.

Referring to FIG. 2, a buffer layer 120 is positioned on the substrate 110. The buffer layer 120 may have a single-layer or multilayer structure. The buffer layer 120 is shown to be a single layer in FIG. 1, and it may be a multilayer depending on embodiments. The buffer layer 120 may include an organic insulating material or an inorganic insulating material. For example, the buffer layer 120 may include at least one of a silicon nitride (SiNx), a silicon oxide (SiOx), and a silicon oxynitride (SiOxNy).

A first semiconductor layer 130 including a first region 131, a second region 132, and a third region 133 is positioned on the buffer layer 120.

The semiconductor layer 130 may include polysilicon, for example, it may include low temperature poly silicon (LTPS).

The first region 131 of the semiconductor layer 130 may be a channel region, and the second region 132 and the third region 133 of the first semiconductor layers 131, 132, and 133 may respectively be a source region and a drain region.

Sheet resistance of the first region 131 that is the channel region of the first semiconductor layers 131, 132, and 133 is greater than sheet resistance of the second region 132 and the third region 133 that are the source region and the drain region of the first semiconductor layers 131, 132, and 133, and a carrier concentration of the first region 131 that is the channel region of the first semiconductor layers 131, 132, and 133 is lower than carrier concentration of the second region 132 and the third region 133 that are the source region and the drain region of the first semiconductor layers 131, 132, and 133.

No impurity may be included in the first region 131 that is the channel region of the first semiconductor layers 131, 132, and 133. The concentration of the impurities of the second region 132 and the third region 133 of the first semiconductor layers 131, 132, and 133 may be higher than the concentration of the impurities of the first region 131 of the first semiconductor layers 131, 132, and 133.

Impurities, for example, n-type impurities or p-type impurities, may be included in the second region 132 and the third region 133 of the first semiconductor layers 131, 132, and 133. For example, the n-type impurities may be P (phosphorus), As (arsenic), and Sb (antimony), and the p-type impurities may be B (boron), Al (aluminum), and In (indium).

A gate insulating film (GI) 141 is positioned in the first region 131 of the first semiconductor layers 131, 132, and 133. The gate insulating film 141 may include an organic insulating material or an inorganic insulating material, for example, the gate insulating film 141 may include at least one of a silicon nitride, a silicon oxide, a silicon oxynitride, and a tetra ethyl ortho silicate (TEOS). A first gate electrode 151 is positioned on the gate insulating film 141.

The first gate electrode 151 is disposed to overlap the first region 131 of the first semiconductor layers 131, 132, and 133, and the gate insulating film 141 is positioned between the first region 131 and the gate electrode 151 of the first semiconductor layers 131, 132, and 133.

The first gate electrode 151 may be a multilayer on which metal films including one of copper (Cu), a copper alloy, aluminum (Al), an aluminum alloy, molybdenum (Mo), and a molybdenum alloy are stacked.

An insulation pattern 142 may be positioned on the buffer layer 120. A bottom gate (BG) electrode 152 may be positioned on the insulation pattern 142. The insulation pattern 142 and the gate insulating film 141 may be formed in a same process stage, and the bottom gate electrode 152 and the first gate electrode 151 may be formed in a same process stage.

A passivation layer 160 is positioned on the first semiconductor layers 131, 132, and 133, the first gate electrode 151, and the bottom gate electrode 152. The passivation layer 160 may include at least one of a silicon nitride, a silicon oxide, a silicon oxynitride, and a tetra ethyl ortho silicate (TEOS), and may be made of an organic material such as a polyacrylate resin or a polyimide resin, or a stacked film of organic materials and inorganic materials.

The passivation layer 160 includes a first contact hole 162 overlapping the second region 132 of the first semiconductor layers 131, 132, and 133 and a second contact hole 163 overlapping the third region 133 of the first semiconductor layers 131, 132, and 133.

Second semiconductor layers 171, 172, and 173 overlapping the bottom gate electrode 152 and including a first region 171, a second region 172, and a third region 173 are positioned on the passivation layer 160. The second semiconductor layers 171, 172, and 173 may include oxide semiconductors.

The oxide semiconductor may include at least one of unary metal oxides such as an indium (In)-based oxide, a tin (Sn)-based oxide, or a zinc (Zn)-based oxide; binary metal oxides such as an In—Zn-based oxide, an Sn—Zn-based oxide, an Al—Zn-based oxide, a Zn—Mg-based oxide, an-Sn—Mg based oxide, an In—Mg-based oxide, or an In—Ga-based oxide; ternary metal oxides such as an In—Ga—Zn-based oxide, an In—Al—Zn-based oxide, an In—Sn—Zn-based oxide, an Sn—Ga—Zn-based oxide, an Al—Ga—Zn-based oxide, an Sn—Al—Zn-based oxide, an In—Hf—Zn-based oxide, an In—La—Zn-based oxide, an In—Ce—Zn-based oxide, an In—Pr—Zn-based oxide, an In—Nd—Zn-based oxide, an In—Sm—Zn-based oxide, an In—Eu—Zn-based oxide, an In—Gd—Zn based oxide, an In—Tb—Zn-based oxide, an In—Dy—Zn-based oxide, an In—Ho—Zn based-oxide, an In—Er—Zn-based oxide, an In—Tm—Zn-based oxide, an In—Yb—Zn-based oxide, or an In—Lu—Zn-based oxide; and quaternary metal oxides such as an In—Sn—Ga—Zn-based oxide, an In—Hf—Ga—Zn-based oxide, an In—Al—Ga—Zn-based oxide, an In—Sn—Al—Zn-based oxide, an In—Sn—Hf—Zn-based oxide, or an In—Hf—Al—Zn-based oxide. For example, the second semiconductor layer 130*a* may include the indium-gallium-zinc oxide (IGZO) from among the In—Ga—Zn-based oxides.

The second semiconductor layers 171, 172, and 173 may include at least one of IGZO (Indium-Gallium-Zinc Oxide), IZTO (Indium-Zinc-Tin Oxide), IGZTO (Indium-Gallium-Zinc-Tin Oxide), and IGO (Indium-Gallium Oxide).

The first region 171 of the second semiconductor layers 171, 172, and 173 may be the channel region, and the second region 172 and the third region 173 of the semiconductor layers 171, 172, and 173 may be the source region and the drain region.

A first source electrode 71 and a first drain electrode 72 are positioned on the passivation layer 160, and a second source electrode 73 and a second drain electrode 74 are positioned on the passivation layer 160 and the second semiconductor layers 171, 172, and 173.

The first source electrode 71 and the first drain electrode 72 are connected to the second region 132 that is the source regions of the first semiconductor layers 131, 132, and 133 and the third region 133 that is the drain regions of the first semiconductor layers 131, 132, and 133 through the first contact hole 162 and the second contact hole 163 of the passivation layer 160.

The second source electrode 73 and the second drain electrode 74 may be positioned on the second region 172 that is the source regions of the second semiconductor layers 171, 172, and 173 and the third region 173 that is the drain regions of the second semiconductor layers 171, 172, and 173.

The first source electrode 71, the first drain electrode 72, the second source electrode 73, and the second drain electrode 74 may include an aluminum-based metal, a silver-based metal, and a copper-based metal with low resistivity, for example, they may have a triple-layered structure including a lower layer including a refractory metal such as titanium, molybdenum, chromium, and tantalum, or an alloy thereof, an intermediate layer including an aluminum-based metal, a silver-based metal, and a copper-based metal with low resistivity, and an upper layer including a refractory metal such as titanium, molybdenum, chromium, and tantalum.

A second gate insulating film 180 may be positioned on the first source electrode 71, the first drain electrode 72, the second source electrode 73, and the second drain electrode 74, and a top gate (TG) electrode 153 may be positioned on the second gate insulating film 180.

The top gate electrode 153 and the bottom gate electrode 152 may overlap the first region 171 that is the channel regions of the second semiconductor layers 171, 172, and 173.

A second protection layer 190 may be positioned on the second gate electrode 153.

The first semiconductor layers 131, 132, and 133 may form a first transistor 200 together with the first gate electrode 151, the first source electrode 71, and the first drain electrode 72. A channel region of the first transistor 200 is formed in the first region 131 between the second region 132 and the third region 133 of the first semiconductor layers 131, 132, and 133.

Similarly, the second semiconductor layers 171, 172, and 173 may form a second transistor 300 together with the bottom gate electrode 152, the top gate electrode 153, the second source electrode 73, and the second drain electrode 74. A channel region of the second transistor 300 is formed in the first region 171 between the second region 172 and the third region 173 of the second semiconductor layers 171, 172, and 173.

Although not shown in FIG. 2, a contact hole to be connected to a line (not shown) for the first source electrode 71 and the second source electrode 73 to supply a predetermined voltage may be positioned on at least one of the second gate insulating film 180 and the second protection layer 190. A contact hole for connecting the first drain electrode 72 and the second drain electrode 74 to each other may be positioned on at least one of the second gate insulating film 180 and the second protection layer 190.

Figure 3A:
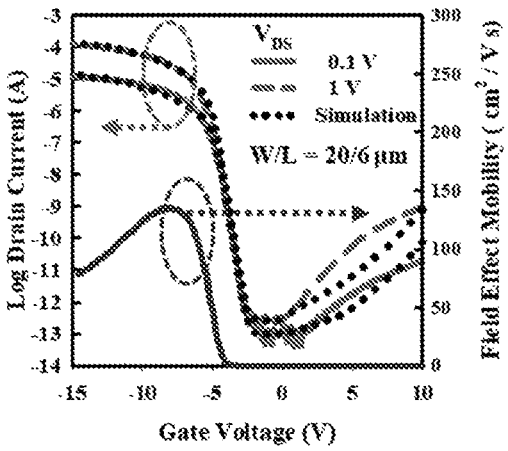
FIG. 3A shows a curved line of a transmission characteristic of a first transistor according to an embodiment.

FIG. 3A shows a curved line of a transmission characteristic of a first transistor according to an embodiment.

Figure 3B:
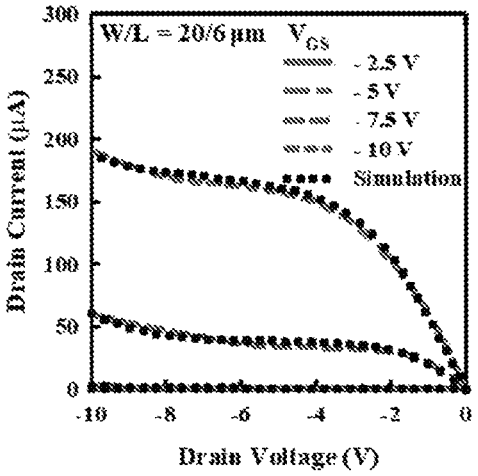
FIG. 3B shows a curved line of an output characteristic of a first transistor according to an embodiment.

FIG. 3B shows a curved line of an output characteristic of a first transistor according to an embodiment.

The first transistor 200 shows field effect mobility ($\mu_{FE}$) of ~130 $cm^2/Vs$, subthreshold swing (SS) of ~0.3 V/dec, and a threshold voltage ($V_{TH}$) of ~4.2 V.

Figure 4A:
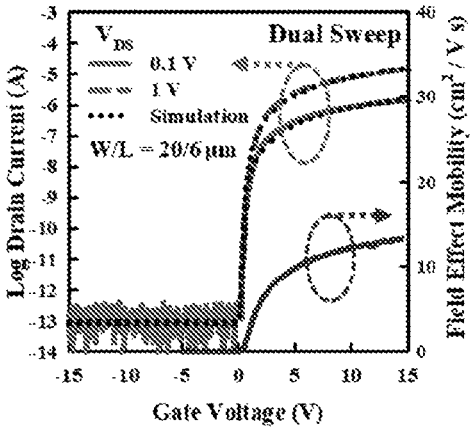
FIG. 4A shows a curved line of a transmission characteristic of a second transistor according to an embodiment.

FIG. 4A shows a curved line of a transmission characteristic of a second transistor according to an embodiment.

Figure 4B:
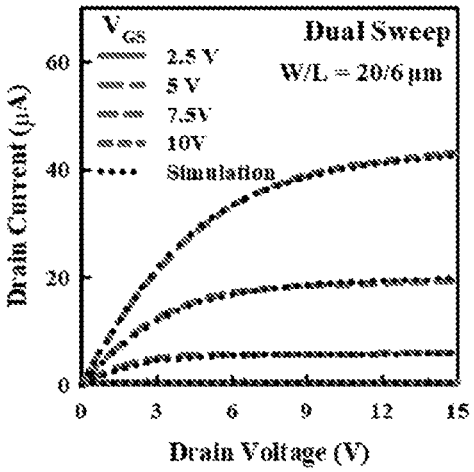
FIG. 4B shows a curved line of an output characteristic of a second transistor according to an embodiment.

FIG. 4B shows a curved line of an output characteristic of a second transistor according to an embodiment.

The second transistor 300 shows the field effect mobility ($\mu_{FE}$) of −13 $cm^2/Vs$, the subthreshold swing (SS) of −0.1 V/dec, and the threshold voltage ($V_{TH}$) of 0.5 V.

Figure 5:
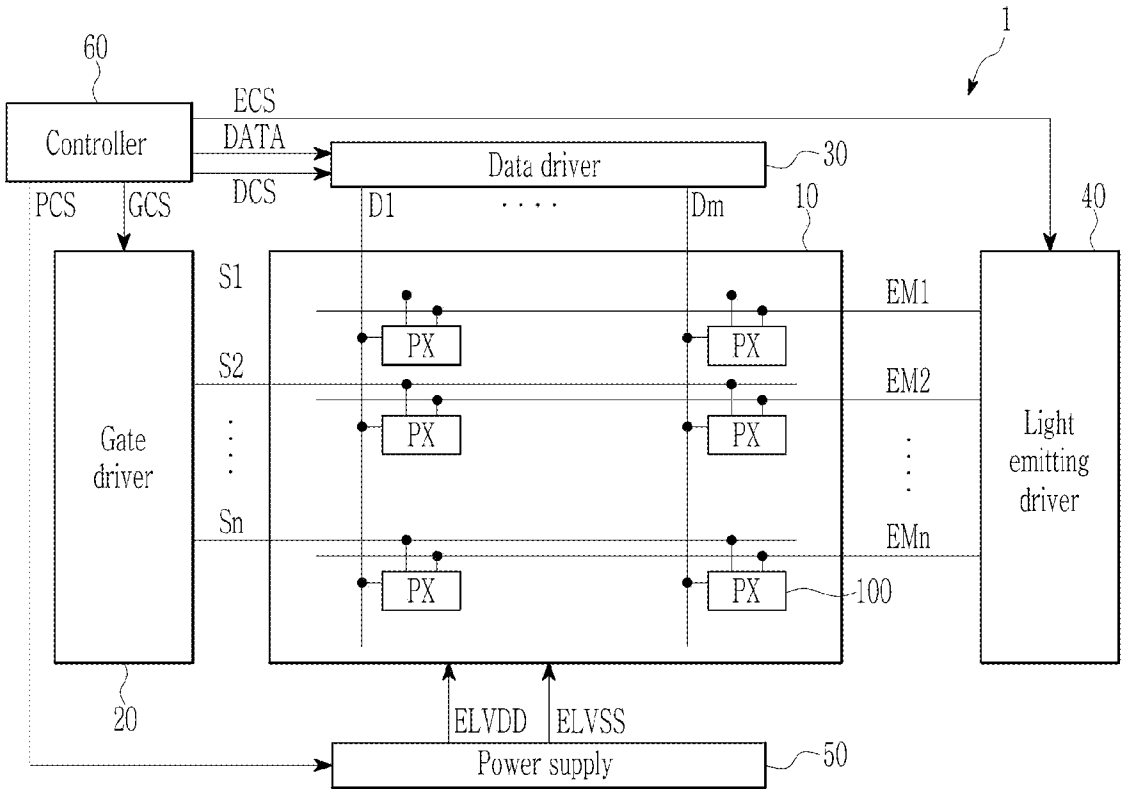
FIG. 5 shows a display according to an embodiment.

FIG. 5 shows a display according to an embodiment.

As shown in FIG. 5, the display 1 includes a display unit 10 including a plurality of pixels PX, a gate driver 20, a data driver 30, a light emitting driver 40, a power supply 50, and a controller 60.

The pixels PX are respectively connected to a corresponding gate line from among a plurality of gate lines S1 to Sn connected to the display unit 10, a corresponding light emitting control line from among a plurality of light emitting control lines EM1 to EMn, and a corresponding data line from among a plurality of data lines D1 to Dm. Although not directly shown in the display unit 10 of FIG. 5, the pixels PX may respectively be connected to two power supply lines connected to the display unit 10 and may receive a first power voltage ELVDD and a second power voltage ELVSS. Although not directly shown in FIG. 5, an initialization voltage for initializing the pixel circuit may be supplied to the pixel circuit through an additional line before the data signal is applied to the pixel circuit.

The display unit 10 includes a plurality of pixels PX substantially arranged in a matrix form. Although not specifically limited, the gate lines S1 to Sn and the light emitting control lines EM1 to EMn face each other, extend in a row direction, and are substantially parallel to each other in an arranged form of pixels, and a plurality of data lines D1 to Dm substantially extend in a column direction and are substantially parallel to each other.

A plurality of pixels PX of the display unit 10 are connected to the corresponding gate lines. One corresponding gate line may be connected to a pixel row configured with a plurality of pixels PX. However, the present invention is not limited thereto, and a number of gate lines connected to the pixel row may be two depending on the pixel circuit. The pixels PX emit light with predetermined luminance by a driving current supplied to an organic light emitting diode according to the corresponding data signal transmitted to the data lines D1 to Dm.

The gate driver 20 generates gate signals corresponding to the respective pixels and transmits them through the gate lines S1 to Sn. That is, the gate driver 20 may transmit the gate signals through the gate lines corresponding to the pixels included in the respective pixel rows.

The gate driver 20 may receive a gate driving control signal GCS from the controller 60, may generate gate signals, and may sequentially supply the gate signals to the gate lines S1 to Sn connected to the respective pixel rows.

The data driver 30 may transmit data signals to the respective pixels through the data lines D1 to Dm. The data driver 30 receives a data driving control signal DCS from the controller 60 and supplies the data signals corresponding to the data lines D1 to Dm connected to the pixels included in the respective pixel rows.

The light emitting driver 40 is connected to the light emitting control lines EM1 to EMn. That is, the light emitting control lines EM1 to EMn substantially facing the pixels in the row direction and extending in parallel to each other connect the respective pixels and the light emitting driver 40.

The light emitting driver 40 generates light emitting control signals corresponding to the respective pixels and transmits them through the light emitting control lines EM1 to EMn. When receiving the light emitting control signals, the respective pixels are controlled to emit light of images corresponding to the image data signal in response to a control of the light emitting control signal. That is, operations of the light emitting control transistors included in the respective pixels are controlled in response to the light emitting control signal transmitted through the corresponding light emitting control line, and the organic light emitting diode connected to the light emitting control transistor may or may not emit light with luminance caused by a driving current corresponding to the data signal.

The power supply 50 supplies the first power voltage ELVDD and the second power voltage ELVSS to the pixels PX of the display unit 10. The first power voltage ELVDD may be a predetermined high-level voltage, and the second power voltage ELVSS may be lower than the first power voltage ELVDD. Voltage values of the first power voltage ELVDD and the second power voltage ELVSS are not limited, and may be set or controlled by control of the power control signal PCS transmitted from the controller 60.

The controller 60 converts a plurality of image signals transmitted from an outside into a plurality of image data signals DATA and transmits them to the data driver 30. The controller 60 receives a vertical synchronization signal Vsync, a horizontal synchronizing signal Hsync, and a clock signal MCLK (not shown), generates control signals for controlling driving of the gate driver 20, the light emitting driver 40, and the data driver 30, and transmits the control signals to the same. That is, the controller 60 generates a gate driving control signal GCS for controlling the gate driver 20, a light emitting driving control signal ECS for controlling operations of the light emitting driver 40, and a data driving control signal DCS for controlling the data driver 30, and transmits them.

The controller 60 generates a power control signal PCS for controlling driving of the power supply 50 and transmits the same to the power supply 50.

Figure 6:
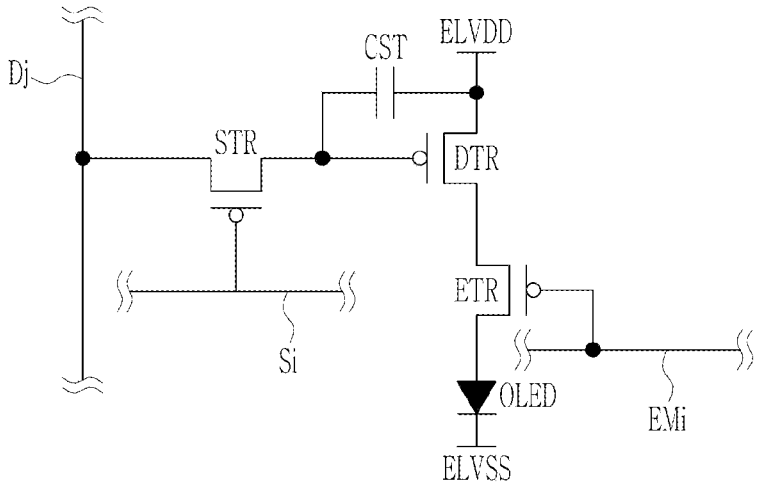
FIG. 6 shows a circuit diagram of a pixel circuit according to an embodiment.

FIG. 6 shows a circuit diagram of a pixel circuit according to an embodiment.

As shown in FIG. 6, the pixels PX may respectively include a driving transistor DTR, a switching transistor STR, a light emitting control transistor ETR, a capacitor CST, and an organic light emitting diode OLED. The pixel circuit shown in FIG. 6 represents an example for describing one of various pixel circuits, and the present invention is not limited thereto. Various types of pixel circuits known to a person of ordinary skill in the art may be applied to the present invention.

The first power voltage ELVDD is supplied to a source of the driving transistor DTR, a first end of the switching transistor STR is connected to a gate of the driving transistor DTR, and the capacitor CST is connected between the gate and the source of the driving transistor DTR. A data line Dj (j is one of natural numbers of 1 to m) is connected to a second end of the switching transistor STR, and the gate line Si (i is one of natural numbers of 1 to n) is connected to a gate of the switching transistor STR. A first end of the light emitting control transistor ETR is connected to a drain of the driving transistor DTR, a second end of the light emitting control transistor ETR is connected to an anode of the organic light emitting diode OLED, and a gate of the light emitting control transistor ETR is connected to the corresponding light emitting control line EMi. A second power voltage ELVSS is supplied to a cathode of the organic light emitting diode OLED.

When the switching transistor STR is turned on, the data signal transmitted through the data line Dj is written in the capacitor CST, and while the light emitting control transistor ETR is in an On state, the driving transistor DTR supplies a current corresponding to the voltage written in the capacitor CST to the organic light emitting diode OLED.

A capacitor for compensating a threshold voltage of the driving transistor and a switching transistor for supplying an initialization voltage may be additionally positioned on the pixel circuit shown in FIG. 6. Various types of known pixel circuits that are different from the pixel circuit shown in FIG. 6 may be applied to the present invention.

Figure 7:
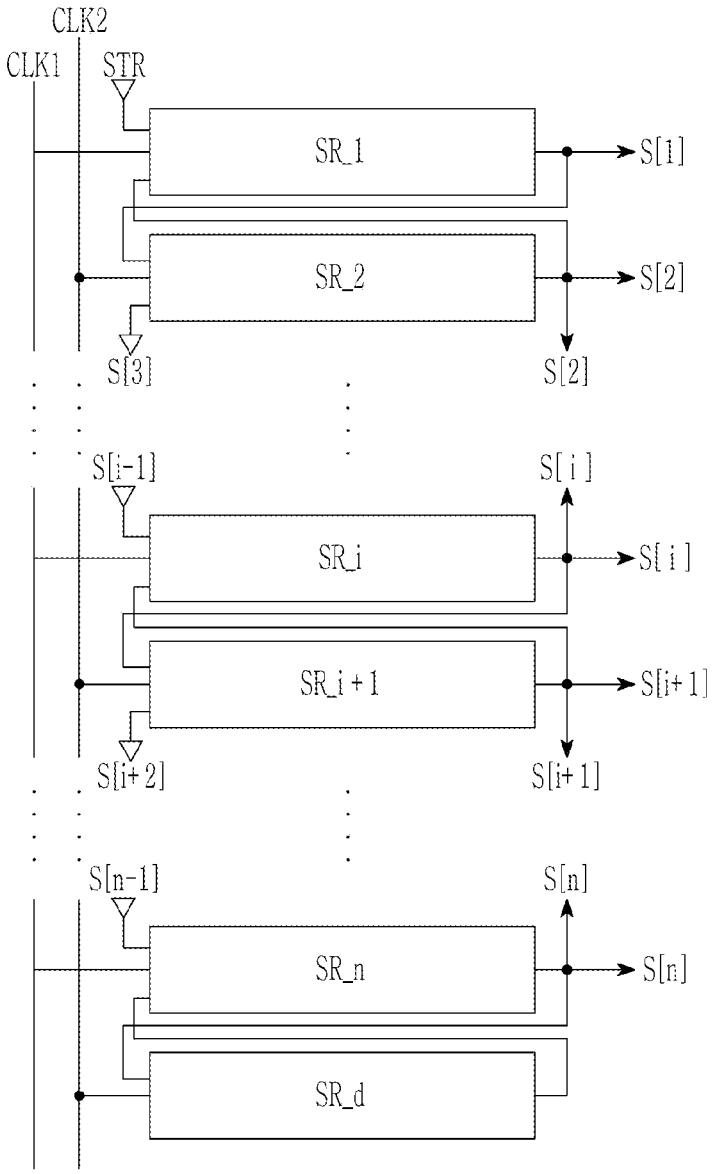
FIG. 7 shows a block diagram of a gate driver according to an embodiment.

FIG. 7 shows a block diagram of a gate driver according to an embodiment.

As shown in FIG. 7, the gate driver 20 includes a plurality of stages SR_1 to SR_n, and the respective stages SR_1 to SR_n may receive a previous gate signal and a next gate signal that are outputs of a previous stage and a next stage, and a clock signal, and may generate a gate signal. A start signal STR instead of the previous gate signal may be input to the first stage SR_1 from among the stages SR_1 to SR_n. To supply a next gate signal to the last stage SR_n from among the stages SR_1 to SR_n, the gate driver 20 may further include a stage SR_d as a dummy. Two clock signals CLK1 and CLK2 may sequentially and alternately correspond to the first stage SR_1 to the last stage SR_n of the stages SR_1 to SR_n, and the corresponding clock signal may be input to the corresponding stage.

The stages SR_1 to SR_n may be respectively synchronized with the corresponding previous gate signals and output a gate signal with an On-level gate pulse (referred to as an On-pulse) based on the corresponding clock signal, and may be synchronized with the corresponding next gate signal and may output an Off-level gate signal.

Figure 8:
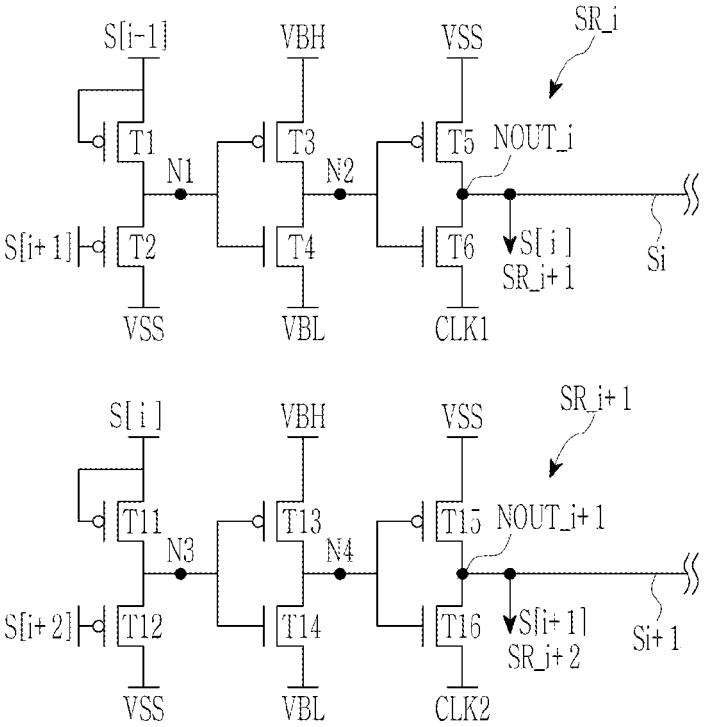
FIG. 8 shows a circuit diagram of two adjacent stages from among a plurality of stages according to an embodiment.

FIG. 8 shows a circuit diagram of two adjacent stages from among a plurality of stages according to an embodiment.

To describe an operation of the gate driver according to an embodiment, FIG. 8 shows a circuit diagram of two adjacent stages SR_i and SR_i+1 from among the stages SR_1 to SR_n.

The stage SR_i includes six transistors T1 to T6. Respective two transistors T3 and T4 and the two transistors T5 and T6 from among the six transistors T1 to T6 are realized with the above-described complementary transistor 100, and may function as an inverter. The transistors T1 and T2 are LTPS TFTs, and may be p-type transistors.

The stage SR_i+1 may also be realized with a same circuit structure as the stage SR_i. The stage SR_i+1 includes six transistors T11 to T16. Respective two transistors T13 and T14 and two transistors T15 and T16 from among the six transistors T11 to T16 are realized with the above-described complementary transistor 100, and may function as an inverter. The transistors T11 and T12 are LTPS TFT, and may be p-type transistors.

On the stage SR_i, a previous gate signal S[i−1] that is an output of a previous stage SR_i−1 is supplied to the drain of the transistor T1, and the gate and the drain of the transistor T1 are connected to each other. That is, the transistor T1 is diode-connected. A source of the transistor T1 is connected to a drain of the transistor T2, and a node N1 on which the transistors T1 and T2 are connected to each other is connected to gates of the transistors T3 and T4. A next gate signal S[i+1] that is an output of the next stage SR_i+1 is supplied to a gate of the transistor T2, and the voltage VSS is supplied to the source of the transistor T2. A voltage VBH is supplied to a source of the transistor T3, a drain of the transistor T3 is connected to the drain of the transistor T4, and a voltage VBL is supplied to a source of the transistor T4. A node N2 on which two transistors T3 and T4 are connected to each other is connected to gates of the two transistors T5 and T6. The voltage VSS is supplied to a source of the transistor T5, a drain of the transistor T5 is connected to a drain of the transistor T6, and a clock signal CLK1 is supply to a source of the transistor T6. A node NOUT_i on which two transistors T5 and T6 are connected to each other is connected to the gate line Si. The gate signal S[i] may be supplied to a plurality of pixels PX of the corresponding pixel row through the gate line S[i]. A voltage at the node NOUT_i may be a voltage at the gate signal S[i].

On the stage SR_i+1, the previous gate signal S[i] that is an output of the previous stage SR_i is supplied to a drain of the transistor T11, and the gate and the drain of the transistor T1 are connected to each other. That is, the transistor T11 is diode connected. The source of the transistor T11 is connected to a drain of the transistor T12, and a node N3 on which two transistors T11 and T12 are connected to each other is connected to gates of the two transistors T13 and T14. A next gate signal S[i+2] that is an output of the next stage SR_i+2 is supplied to a gate of the transistor T12, and the voltage VSS is supplied to a source of the transistor T12. The voltage VBH is supplied to a source of the transistor T13, a drain of the transistor T13 is connected to a drain of the transistor T14, and the voltage VBL is supplied to a source of the transistor T14. A node N4 on which the two transistors T13 and T14 are connected to each other is connected to gates of the transistors T15 and T16. The voltage VSS is supplied to a source of the transistor T15, a drain of the transistor T15 is connected to a drain of the transistor T16, and a clock signal CLK2 is supplied to a source of the transistor T16. A node NOUT_i+1 on which the two transistors T15 and T16 are connected to each other is connected to the gate line Si+1. The gate signal S[i+1] may be supplied to a plurality of pixels PX of the corresponding pixel row through the gate line Si+1.

The voltage VSS is an Off-level voltage of the gate signals S[i] and S[i+1], and it may be a high-level voltage depending on embodiments. The voltage VBH may be an Off-level for the transistors T5 and T15 and may be an On-level for the transistors T6 and T16, and the voltage VBL may be an On-level for the transistors T5 and T15 and may be an Off-level for the transistors T6 and T16.

An operation of a stage according to an embodiment will now be described with reference to FIG. 9.

Figure 9:
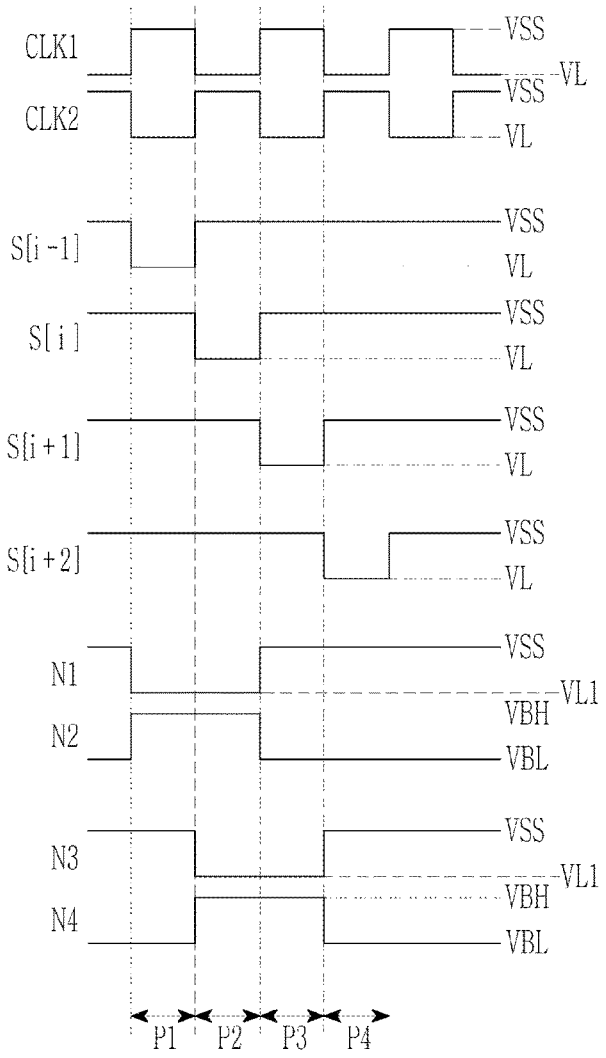
FIG. 9 shows a waveform diagram of clock signals, gate signals, and voltages at nodes according to an embodiment.

FIG. 9 shows a waveform diagram of clock signals, gate signals, and voltages at nodes according to an embodiment.

The clock signals CLK1 and CLK2 periodically and alternately have the high-level voltage VSS and the low-level voltage VL, and may have phases that are opposite to each other. A threshold voltage VTH of the transistors T1 and T11 may be a negative voltage.

For a period P1, the gate signal S[i−1] has an On-level. The transistor T1 is turned on, and the voltage at the node N1 becomes a voltage VL-VTH of VL1 that is a subtraction of the threshold voltage VTH of the transistor T1 from the voltage VL of the gate signal S[i−1]. The voltage VL1 may be a low-level voltage for turning on the transistor T3. The transistor T3 is tuned on by the voltage VL1, and the transistor T4 is turned off, so the voltage at the node N2 is charged with the voltage VBH. By the voltage VBH, the transistor T6 is turned on and the transistor T5 is turned off. The clock signal CLK1 is supplied as a gate signal S[i] to the gate line (Si) through the transistor T6 that is turned on. As the clock signal CLK1 is the voltage VSS for the period P1, the gate signal S[i] is maintained at the voltage VSS.

When the period P1 ends, the gate signal S[i−1] becomes the high-level voltage VSS, and the transistor T1 is blocked. For a period P2, without bootstrapping, the voltage at the node N1 is maintained at the voltage VL1, the voltage at the node N2 is maintained at the voltage VBH, and the transistors T3 to T6 maintain the state of the period P1. For the period P2, as the clock signal CLK1 is the low-level voltage VL, the gate signal S[i] is charged with the On-level voltage VL.

For the period P2, as the gate signal 0 is On-level, the transistor T11 is turned on and the voltage at the node N3 becomes a voltage VL-VTH of VL1 that is a subtraction of the threshold voltage VTH of the transistor T11 from the voltage VL of the gate signal 0. The voltage VL1 may be a low-level voltage for turning on the transistor T13. By the voltage VL1, the transistor T13 is turned on, the transistor T14 is turned off, and the voltage at the node N4 is changed with the voltage VBH. By the voltage VBH, the transistor T16 is turned on and the transistor T15 is turned off. The clock signal CLK2 is supplied as the gate signal S[i+1] to the gate line Si+1 through the transistor T16 that is in the On state. For the period P2, as the clock signal CLK2 is the voltage VSS, the gate signal S[i+1] is maintained at the voltage VSS.

When the period P2 ends, the gate signal 0 becomes a high-level voltage VSS and the transistor T11 is blocked. For a period P3, without bootstrapping, the voltage at the node N3 is maintained at the voltage VL1, the voltage at the node N4 is maintained at the voltage VBH, and the transistors T13 to T16 maintain the state of the period P2. For the period P3, as the clock signal CLK2 has the low-level voltage VL, the gate signal S[i+1] is changed with the On-level voltage VL.

For the period P3, as the gate signal S[i+1] is On-level, the transistor T2 is in the On state. The voltage at the node N1 becomes the voltage VSS, and by the voltage VSS, the transistor T4 is turned on and the transistor T3 is turned off. The voltage at the node N2 is pulled down to the voltage VBL through the transistor T4 that is in the On state. By the voltage VBL, the transistor T5 is turned on and the transistor T6 is turned off. The gate signal S[i] is discharged to be the voltage VSS through the transistor T5 that is in the On state.

For a period P4, as the gate signal S[i+2] is On-level, the transistor T12 is in the On state. The voltage at the node N3 becomes voltage VSS, and by the voltage VSS, the transistor T14 is tuned on and the transistor T13 is turned off. The voltage at the node N4 is pulled down to the voltage VBL through the transistor T14 that is in the On state. By the voltage VBL, the transistor T15 is turned on and the transistor T16 is turned off. The gate signal S[i+1] is discharged to be the voltage VSS through the transistor T15 that is in the On state.

According to the above-described operation, the stages SR_1 to SR_n may sequentially supply a plurality of On-level gate signals S[1] to S[n] to the gate lines S1 to Sn.

When the resolution of the display 1 is 4K (3840×2160), an operational frequency of the gate driver 20 may be 120 Hz. The clock signals CLK1 and CLK2 and the gate signals S[1] to S[n] may swing between the voltage VSS and the voltage VL. Table 1 expresses parameters of the six transistors T1 to T6 configuring the respective stages when a simulation on the operation of the gate driver according to an embodiment is performed.

TABLE 1

| | Parameters (W/L) |
|---|---|
| T1 (μm/μm) | 10/6 |
| T2 (μm/μm) | 20/6 |
| T3 (μm/μm) | 10/6 |
| T4 (μm/μm) | 50/6 |
| T5 (μm/μm) | 40/6 |
| T6 (μm/μm) | 100/6 |

Figure 10:
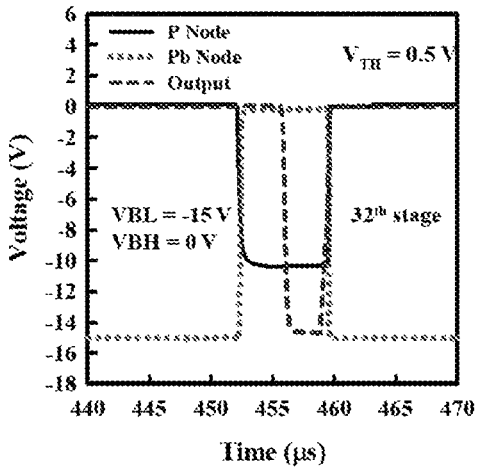
FIG. 10 shows a waveform diagram of an example of stage outputs and voltages at nodes acquired by a first simulation.

FIG. 10 shows a waveform diagram of an example of stage outputs and voltages at nodes acquired by a first simulation.

FIG. 10 shows the simulation on the 32-th one of a plurality of stages configuring the gate driver 20, the threshold voltage of the a-IGZO TFTs (e.g., T4 and T6) is 0.5 V, the voltage VBL is −15 V, the voltage VBH is 0 V, the voltage VL is −15 V, and the voltage VSS is 0 V. Transmission characteristics and output characteristics of the a-IGZO TFT used to the simulation may follow the waveforms shown in FIG. 4A and FIG. 4B.

Figure 11:
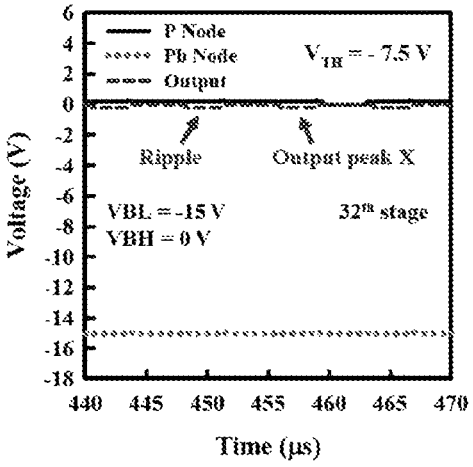
FIG. 11 shows a waveform diagram of an example of stage outputs and voltages at nodes acquired by a second simulation.

FIG. 11 shows a waveform diagram of an example of stage outputs and voltages at nodes acquired by a second simulation.

The waveform shows simulation results for an operation in the depletion mode, and the threshold voltage of the a-IGZO TFTs (e.g., T4 and T6) may be −7.5 V as a simulation condition. Other conditions are identical with the conditions of the simulation of FIG. 10.

As shown in FIG. 10, when the threshold voltage VTH of the a-IGZO TFT is 0.5 V, outputs may be generated with the gate signal according to the voltage VBH of 0 V and the voltage VBL of −15 V. That is, the outputs may be generated as the level for turning the switching transistor (STR of FIG. 6) of the pixel PX on/off.

However, as shown in FIG. 11, when the threshold voltage VTH of the a-IGZO TFT is −7.5 V that is a negative voltage, the output has a waveform from which a peak component is removed and which has a ripple component. This is because the a-IGZO TFT is operated in a severe depletion mode. The depletion mode may be easily generated in the process for manufacturing the a-IGZO TFT, and in the case of long driving, the threshold voltage may be moved to a negative voltage because of a bias stress. Therefore, to check whether the gate driver including the a-IGZO TFT is normally operated, it must be considered whether an output is normally generated when the a-IGZO TFT is operated in the depletion mode.

Figure 12:
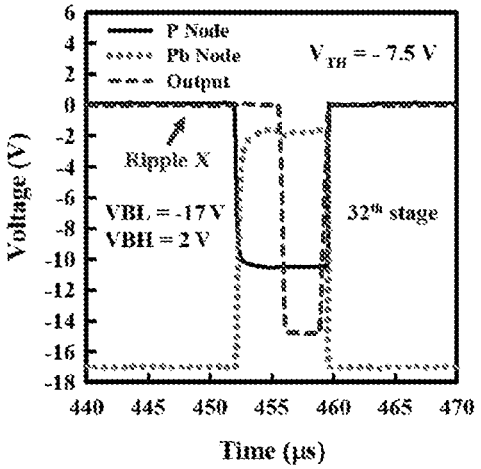
FIG. 12 shows a waveform diagram of an example of stage outputs and voltages at nodes acquired by a third simulation.

FIG. 12 shows a waveform diagram of an example of stage outputs and voltages at nodes acquired by a third simulation.

The simulation condition for acquiring the waveform shown in FIG. 12 is: the threshold voltage of the a-IGZO TFTs T4 and T6 is −7.5 V, the voltage VBL is −17 V, and the voltage VBH is 2 V. The transmission characteristic of the a-IGZO TFT used to the simulation may follow the waveform shown in FIG. 13. Other conditions are identical with the conditions of the simulation of FIG. 10.

As shown in FIG. 12, when the a-IGZO TFT is operated in the depletion mode, the output may be generated to be a gate signal that has the Off-level of about 0 V and the On-level of about −14.5 V by the voltage VBH of 2 V and the voltage VBL of −17 V. That is, the output may be generated to be a level that may turn the switching transistor (STR of FIG. 6) of the pixel PX on/off.

Figure 13:
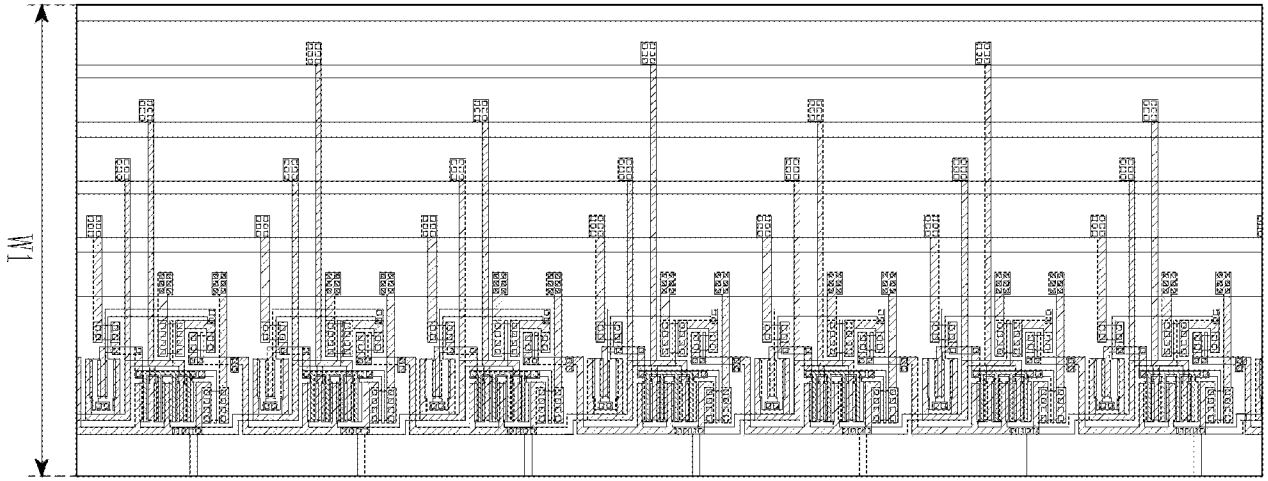
FIG. 13 shows a top plan view of a layout of some stages from among a gate driver according to an embodiment.

FIG. 13 shows a top plan view of a layout of some stages from among a gate driver according to an embodiment.

A width w1 of the stage is equal to or less than 300 um, and it is found that the width is reduced compared to prior art. This is because there is no need to use a capacitor for a bootstrapping by using the inverter realized with the a-IGZO transistor in the gate driver 20. A size of the conventional gate driver needing the capacitor is increased because of the capacitor.

Figure 14:
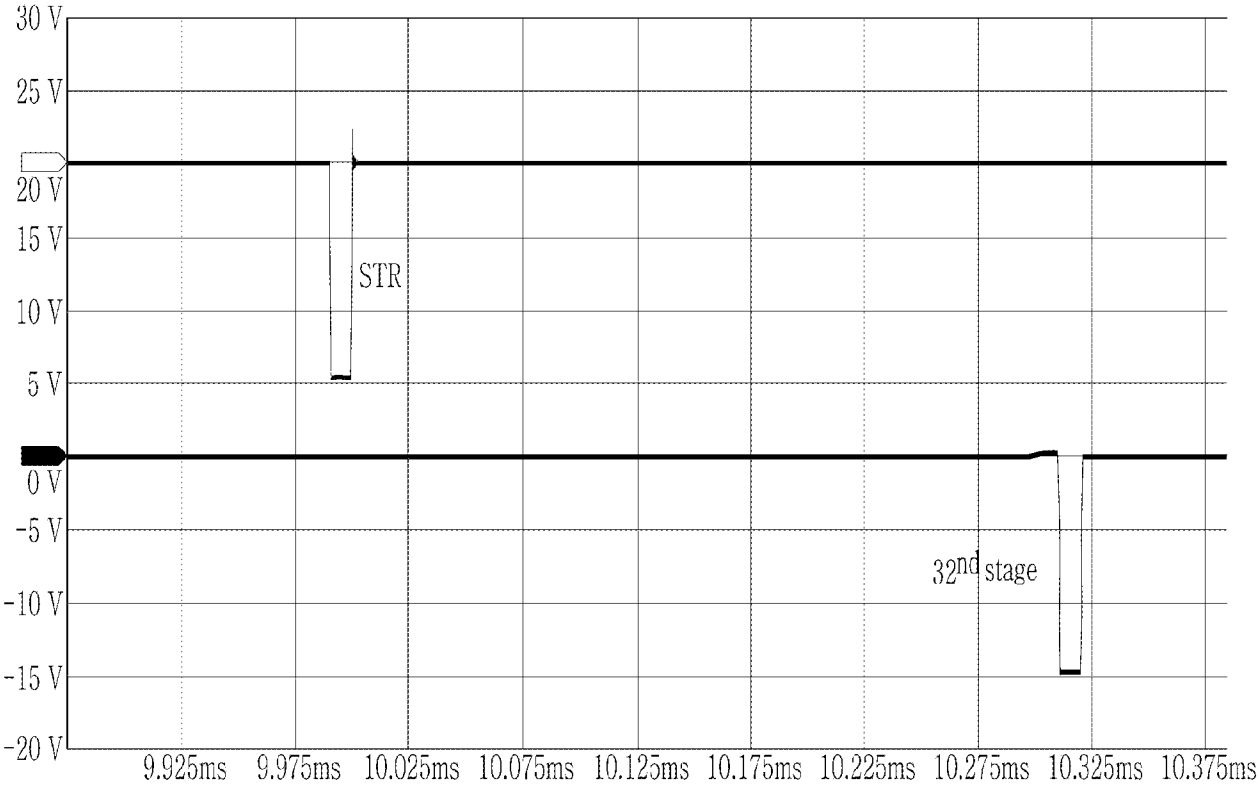
FIG. 14 and FIG. 15 show gate signal waveform diagrams of a first stage and a 32-nd stage according to simulations.
Figure 15:
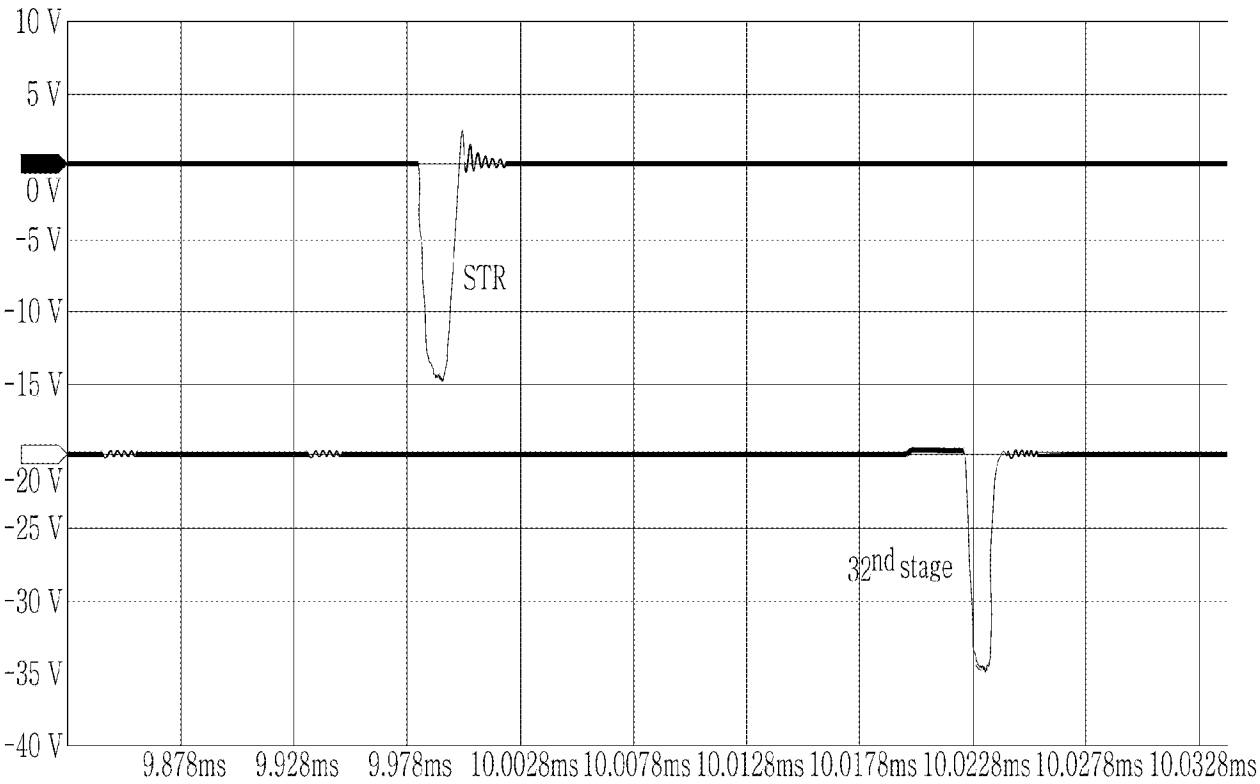

FIG. 14 and FIG. 15 show gate signal waveform diagrams of a first stage and a 32-nd stage according to simulations.

The width of the On-level pulse of the gate signal shown in FIG. 14 is 10 us, and the width of the On-level pulse of the gate signal shown in FIG. 15 is 1 us. For the purpose of a simulation, resistance and capacitance that are output loads of the first and 32-nd stages are set to be 6 kΩ and 12 pF.

It is found that a rising time and a falling time of the gate signal with the width of 10 us are equal to or less than 230 ns and equal to or less than 900 ns, and the rising time and the falling time of the gate signal with the width of 1 us are equal to or less than 230 ns and equal to or less than 250 ns. When the rising time and the falling time are considered, the gate driver according to an embodiment may be applied to the display with the driving frequency of 240 Hz and the resolution of 8K (7680×4320).

Figure 16:
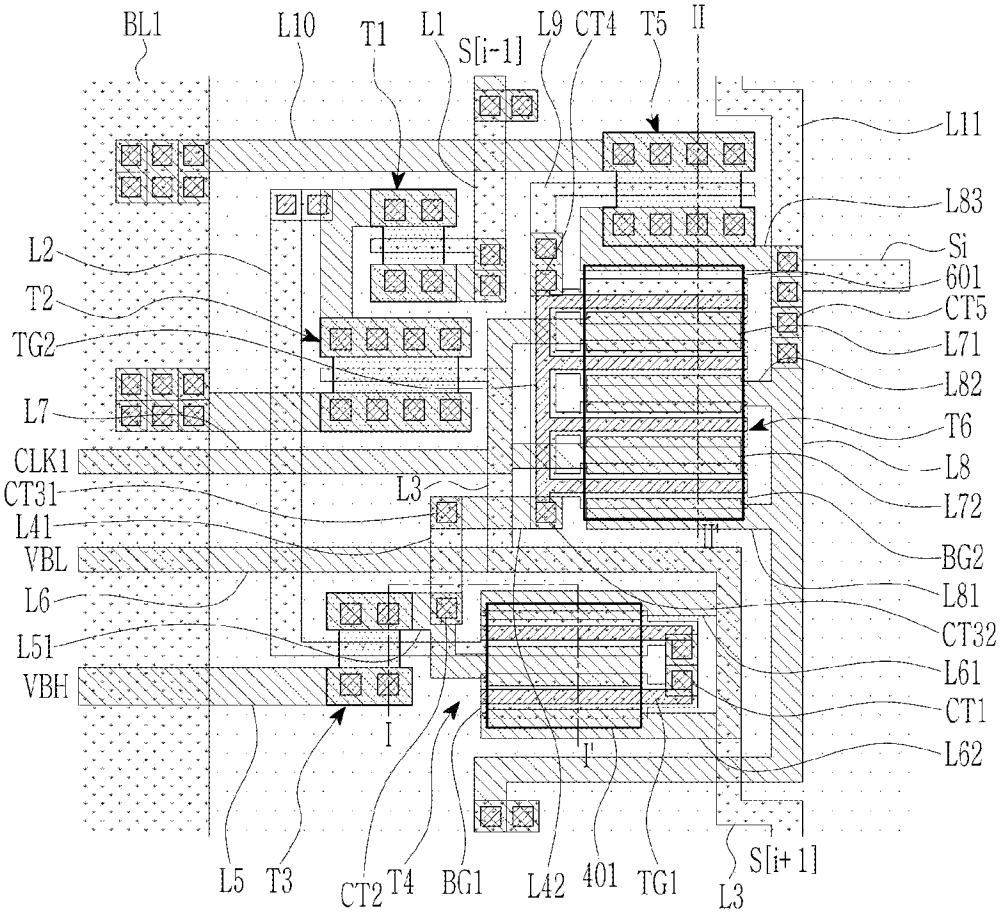
FIG. 16 shows a top plan view of a layout of an i-th stage shown in FIG. 8.

FIG. 16 shows a top plan view of a layout of an i-th stage shown in FIG. 8.

Figure 17:
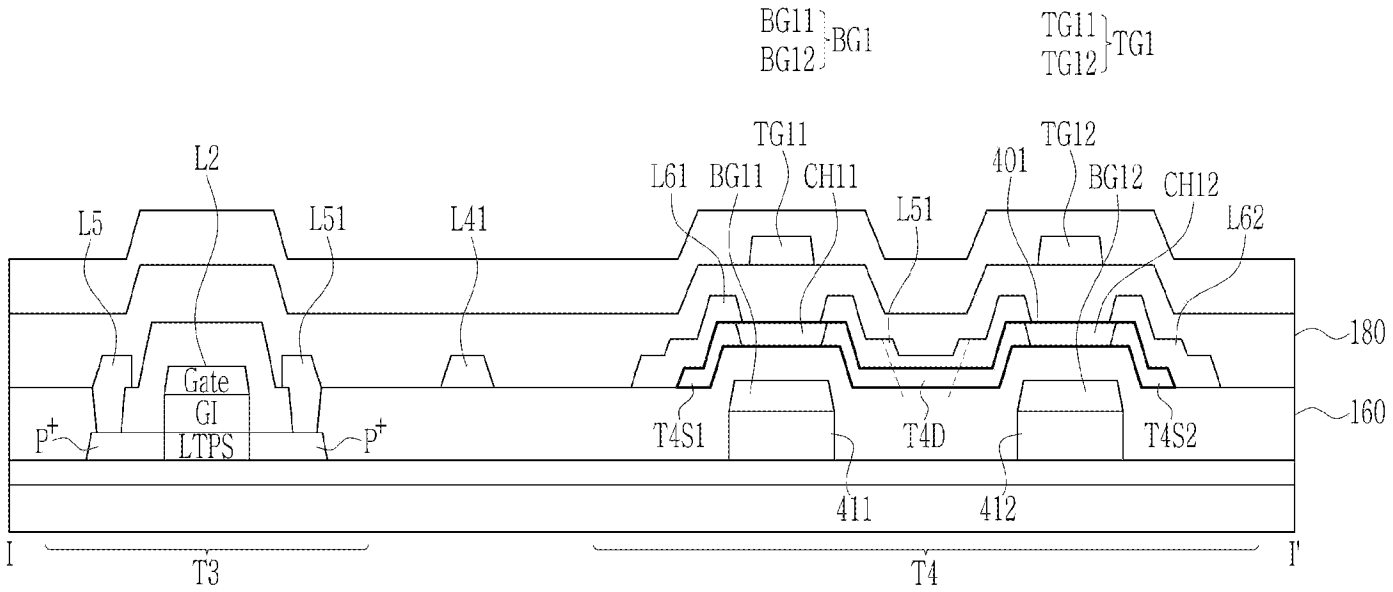
FIG. 17 shows a cross-sectional view with respect to a line I-I' in FIG. 16.

FIG. 17 shows a cross-sectional view with respect to a line A-A'.

Figure 18:
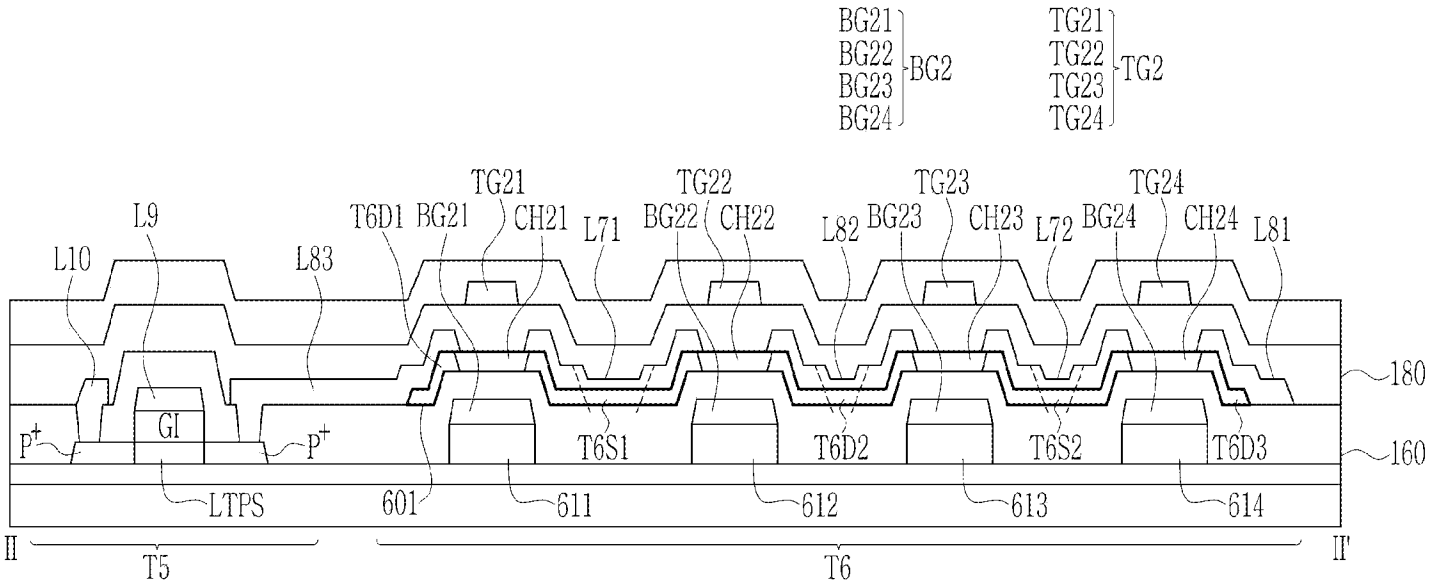
FIG. 18 shows a cross-sectional view with respect to a line II-II' in FIG. 16.

FIG. 18 shows a cross-sectional view with respect to a line B-B' in FIG. 17.

FIG. 16 shows one BL1 of five bus lines shown in FIG. 13. The line may be made of a conductive material in the following description. When a description on a predetermined layer is needed, a layout in which a certain layer covering the predetermined layer is removed may be shown. A semiconductor layer 401 realized with low-temperature polysilicon and a semiconductor layer 601 realized with the a-IGZO are marked with thick solid lines so as to be distinguished from other layers.

As shown in FIG. 16, the drain of the transistor T1 is connected to the line L1 for transmitting the gate signal S[i−1], and the gate of the transistor T1 extends from the line L1. The source of the transistor T1 and the drain of the transistor T2 are connected to a line L2, the gate of the transistor T2 extends from the line L3 for transmitting the gate signal S[i+1], and the source of the transistor T2 is connected to the bus line BL1 for supplying the voltage VSS.

The line L2 may correspond to the node N1. The gate of the transistor T3 and the bottom gate BG1 of the transistor T4 extend from the line L2. The top gate TG1 and the bottom gate BG1 of the transistor T4 are connected to each other through a via contact CT1. The drain of the transistor T3 and the drain of the transistor T4 may be connected to a line L51, and the line L51 may be connected to a line L41 through a via contact CT2. The line L41 and the line L42 may be connected to each other through a via contact CT31, and the line L42 and the line L9 may be connected to each other through via contact CT32. The source of the transistor T3 is connected to the line L5, and the voltage VBH may be supplied through the line L5. Two lines L61 and L62 are connected to the source of the transistor T4, and may be branched from the line L6 and may extend. The voltage VBL may be supplied through the line L6.

The bottom gate BG2 of the transistor T6 is branched from the line L9 and extends. The bottom gate BG2 and the top gate TG2 are connected to each other through a via contact CT4, and the gate of the transistor T5 extends from the line L9.

The source of the transistor T6 is connected to two lines L71 and L72, and the lines L71 and L72 may be branched from a line L7 and may extend. The clock signal CLK1 may be supplied to the line L7. The drain of the transistor T6 may be connected to three lines L81, L82, and L83, and the lines L81, L82, and L83 may be branched from the line L8 and may extend. The line L8 is connected to the gate line Si through a via contact CT5. The drain of the transistor T5 is connected to the line L83, and the source of the transistor T5 is connected to a line L10. The line L10 is connected to the bus line BL1, and the voltage VSS is supplied to the source of the transistor T5.

The line L11 is connected to the drains of the transistor T5 and the transistor T6 through a via contact CT5 so the gate signal S[i] may be supplied to the previous stage through the line L11. The gate signal S[i] may be supplied to the next stage through the line L8.

A cross-sectional structure of the transistors T3 and T4 configuring an inverter will now be described with reference to FIG. 17. The same portions as the cross-sectional structure described with reference to FIG. 2 will be omitted.

As shown in FIG. 17, the source and the drain (P+ region) of the transistor T3 are connected to the line L5 and the line L51, and the gate of the transistor T3 extends from the line L2.

Regarding the semiconductor layer of the transistor T4, the a-IGZO layer 401 is formed to have a single layer, and it may be realized into two a-IGZO layers as distinguished with dotted lines. Here, an insulating layer 180 may be positioned in a region between two dotted lines.

The source region T4S1 of the a-IGZO layer 401 is connected to the line L61, the source region T4S2 of the a-IGZO layer 401 is connected to the line L62, and the drain region T4D of the a-IGZO layer 401 is connected to the line L51.

From among two bottom gates BG11 and BG12, the bottom gate BG11 is positioned on an insulation pattern 411 to correspond to a channel region CH11 of the a-IGZO layer 401, and the other bottom gate BG12 is positioned on an insulation pattern 412 to correspond to a channel region CH12 of the a-IGZO layer 401. A passivation layer 160 may be positioned between the a-IGZO layer 401 and the two bottom gates BG11 and BG12.

From among two top gates TG11 and TG12, the top gate TG1 may be positioned on an insulating layer 180 to correspond to a channel region CH11 of the a-IGZO layer 401, and the other top gate TG12 may be positioned on an insulating layer 180 to correspond to a channel region CH12 of the a-IGZO layer 401.

A cross-sectional structure of the transistors T5 and T6 configuring an inverter will now be described with reference to FIG. 18. The same portions as the cross-sectional structure described with reference to FIG. 2 will be omitted.

As shown in FIG. 18, the source and the drain (P+ region) of the transistor T5 are connected to the line L10 and the line L83, and the gate of the transistor T5 extends from the line L9.

Regarding the semiconductor layer of the transistor T6, the a-IGZO layer 601 is formed to have a single layer, and it may be realized into four a-IGZO layers as distinguished with dotted lines. Here, an insulating layer 180 may be positioned in a region between two adjacent dotted lines.

A drain region T6D1 of the a-IGZO layer 601 is connected to the line L83, a source region T6S1 of the a-IGZO layer 601 is connected to the line L71, a drain region T6D2 of the a-IGZO layer 601 is connected to the line L82, a source region T6S2 of the a-IGZO layer 601 is connected to the line L72, and a drain region T6D3 of the a-IGZO layer 601 is connected to the line L81.

From among four bottom gates BG21, BG22, BG23, and BG24, the bottom gate BG21 may be positioned on an insulation pattern 611 to correspond to a channel region CH21 of the a-IGZO layer 601, the bottom gate BG22 may be positioned on an insulation pattern 612 to correspond to a channel region CH22 of the a-IGZO layer 601, the bottom gate BG23 may be positioned on an insulation pattern 613 to correspond to a channel region CH23 of the a-IGZO layer 601, and the bottom gate BG24 may be positioned on an insulation pattern 614 to correspond to a channel region CH24 of the a-IGZO layer 601. A passivation layer 160 may be positioned between the a-IGZO layer 601 and the four bottom gates BG21, BG22, BG23, and BG24.

From among four top gates TG21, TG22, TG23, and TG24, the top gate TG21 may be positioned on the insulating layer 180 to correspond to a channel region CH21 of the a-IGZO layer 601, the top gate TG22 may be positioned on the insulating layer 180 to correspond to a channel region CH22 of the a-IGZO layer 601, the top gate TG23 may be positioned on the insulating layer 180 to correspond to a channel region CH23 of the a-IGZO layer 601, and the top gate TG24 may be positioned on the insulating layer 180 to correspond to a channel region CH24 of the a-IGZO layer 601.

The LTPO TFT may be applied to the gate driver and the light emitting driver.

A light emitting driver according to an embodiment will now be described with reference to FIG. 19 to FIG. 25.

Figure 19:
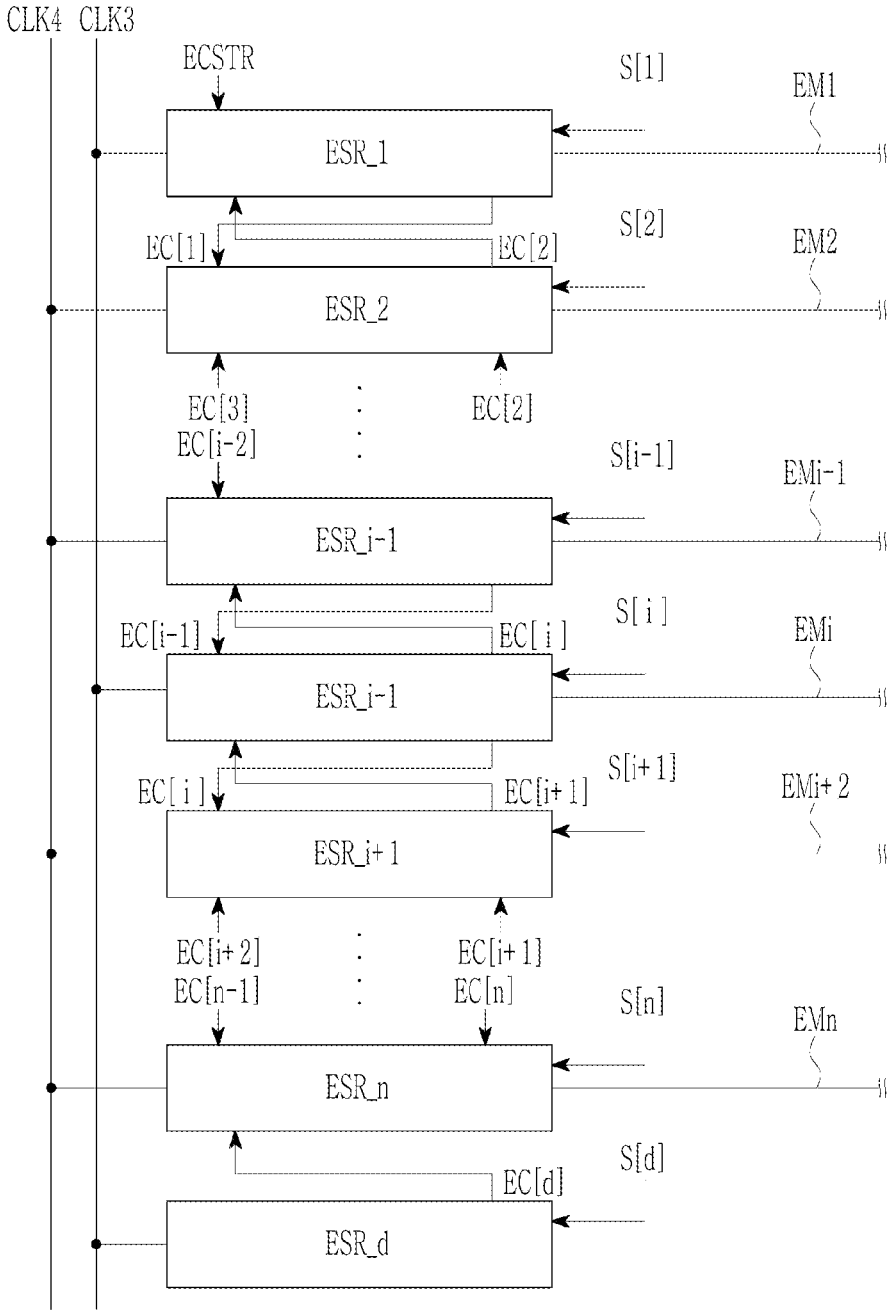
FIG. 19 shows a block diagram of a light emitting driver according to an embodiment.

FIG. 19 shows a block diagram of a light emitting driver according to an embodiment.

As shown in FIG. 19, the light emitting driver 40 includes a plurality of light emitting stages ESR_1 to ESR_n, and the respective light emitting stages ESR_1 to ESR_n may receive a previous light emitting control signal (e.g., EC[i−1]) and a next light emitting control signal (e.g., EC[i+1]) generated by a corresponding previous light emitting stage and a next light emitting stage, a corresponding gate signal (e.g., S[i]), and a corresponding clock signal (e.g., CLK3) and may generate a corresponding light emitting signal (e.g., E[i]). From among the light emitting stages ESR_1 to ESR_n, a light emitting control start signal ECSTR and not a previous light emitting control signal may be input to the first light emitting stage ESR_1. To supply a next light emitting control signal to the last stage ESR_n from among the light emitting stages ESR_1 to ESR_n, the light emitting driver 40 may further include a stage ESR_d as a dummy. Two clock signals CLK3 and CLK4 sequentially and alternately correspond to the first light emitting stage ESR_1 to the last light emitting stage ESR_n of the light emitting stages ESR_1 to ESR_n, and the corresponding clock signals may be input to the corresponding light emitting stages.

The light emitting stages ESR_1 to ESR_n may be synchronized with the corresponding gate signal and may output a corresponding light emitting signal as On-level, may generate a corresponding light emitting control signal according to the corresponding clock signal for a period from a time when the previous light emitting control signal becomes On-level to a time when the next light emitting control signal becomes On-level, and may be synchronized with the time when the corresponding light emitting control signal becomes On-level and may output the corresponding light emitting signal as Off-level.

Figure 20:
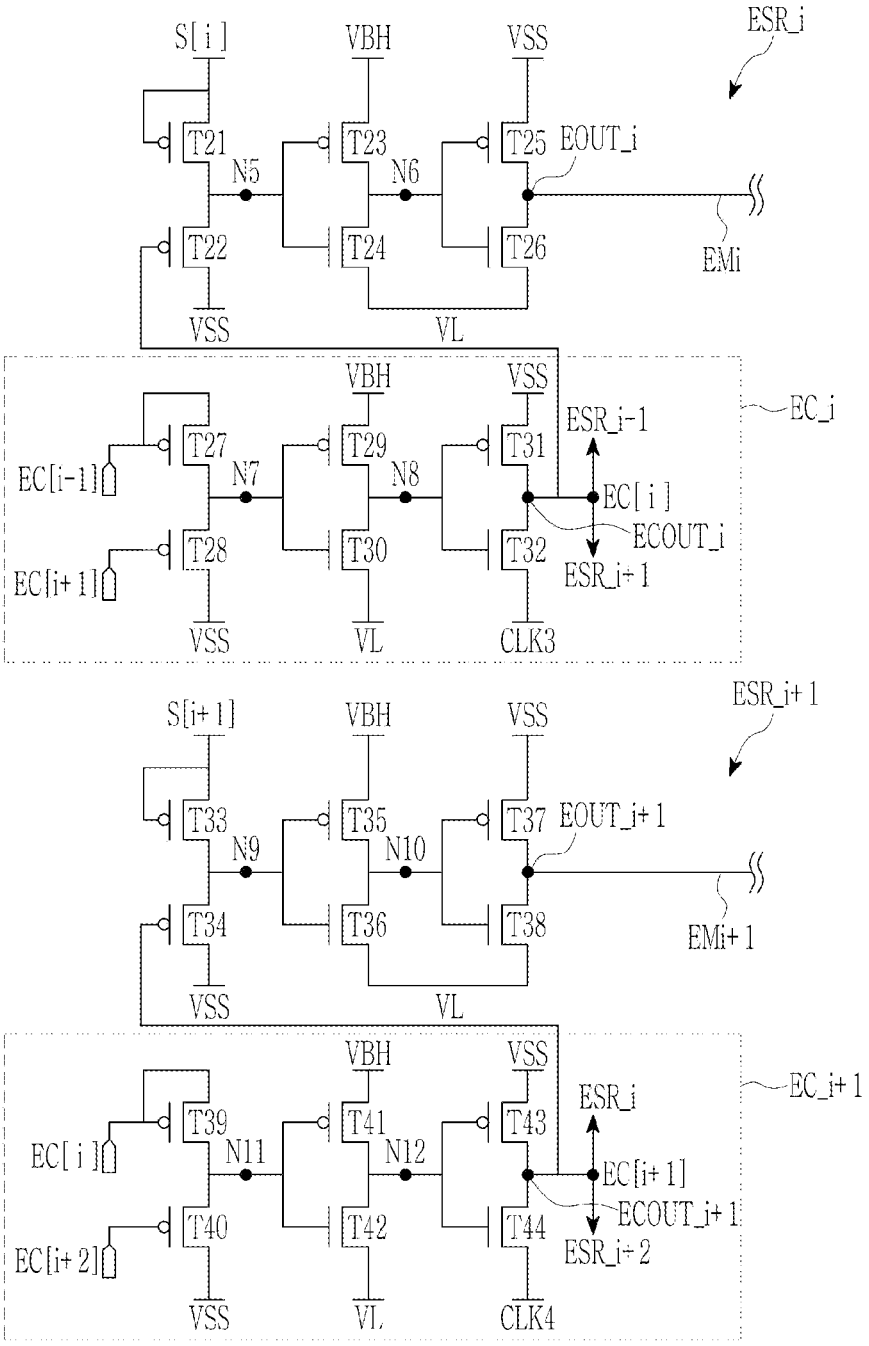
FIG. 20 shows a circuit diagram of two adjacent light emitting stages from among a plurality of light emitting stages according to an embodiment.

FIG. 20 shows a circuit diagram of two adjacent light emitting stages from among a plurality of light emitting stages according to an embodiment.

FIG. 20 shows a circuit diagram of two adjacent light emitting stages ESR_i and ESR_i+1 from among a plurality of light emitting stages ESR_1 to ESR_n, for the purpose of describing an operation of the light emitting driver according to an embodiment.

The light emitting stage ESR_i includes twelve transistors T21 to T32. From among the transistors T21 to T32, the two transistors T23 and T24, the two transistors T25 and T26, the two transistors T29 and T30, and the two transistors T31 and T32 may be respectively realized with the above-described complementary transistor 100, and may be operable as an inverter. The four transistors T21, T22, T27, and T28 are LTPS TFTs and may be p-type transistors.

The light emitting stage ESR_i+1 may be realized with the same circuit structure as the light emitting stage ESR_i. The light emitting stage ESR_i+1 includes twelve transistors T33 to T44. From among the twelve transistors T33 to T44, the two transistors T35 and T36, the two transistors T37 and T38, the two transistors T41 and T42, and the two transistors T43 and T44 may be respectively realized with the above-described complementary transistor 100, and may be operable as an inverter. The four transistors T33, T34, 39, and 40 are LTPS TFTs and may be p-type transistors.

On the light emitting stage ESR_i, the corresponding gate signal S[i] is supplied to a source of the transistor T21, and a gate and the source of the transistor T21 are connected to each other. That is, the transistor T21 is diode-connected. A drain of the transistor T21 is connected to a drain of the transistor T22, and a node N5 on which the two transistors T21 and T22 are connected to each other is connected to gates of the transistors T23 and T24. A light emitting control signal EC[i] is supplied to a gate of the transistor T22, and the voltage VSS is supplied to the source of the transistor T22. The voltage VBH is supplied to a source of the transistor T23, a drain of the transistor T23 is connected to a drain of the transistor T24, and the voltage VL is supplied to a source of the transistor T24. A node N6 on which the two transistors T23 and T24 are connected to each other is connected to gates of the two transistors T25 and T26. The voltage VSS is supplied to a source of the transistor T25, a drain of the transistor T25 is connected to a drain of the transistor T26, and the voltage VL is supplied to a source of the transistor T26. A node EOUT_i on which the two transistors T25 and T26 are connected to each other is connected to the corresponding light emitting control line EMi. A light emitting signal E[i] may be supplied to a plurality of pixels PX of the corresponding pixel row through the light emitting control line EMi.

On the light emitting stage ESR_i, a pulse width of the light emitting signal E[i] may be controlled by the corresponding gate signal S[i] and the light emitting control signal EC[i]. The light emitting stage ESR_i may include a light emitting control circuit EC_i including six transistors T27 to T32 for generating the light emitting control signal EC[i].

On the light emitting control circuit EC_i, a previous light emitting control signal EC[i−1] generated by a previous light emitting stage ECR_i−1 is supplied to a source of the transistor T27, and a gate and the source of the transistor T27 are connected to each other. That is, the transistor T27 is diode-connected. A drain of the transistor T27 is connected to a drain of the transistor T28, and a node N7 on which the two transistors T27 and T28 are connected to each other is connected to gates of the transistors T29 and T30. A next light emitting control signal EC[i+1] generated by the next light emitting stage ECR_i+1 is supplied to a gate of the transistor T28, and the voltage VSS is supplied to a source of the transistor T28. The voltage VBH is supplied to a source of the transistor T29, a drain of the transistor T29 is connected to a drain of the transistor T30, and the voltage VL is supplied to a source of the transistor T30. A node N8 on which the transistors T29 and T30 are connected to each other is connected to gates of the transistors T31 and T32. The voltage VSS is supplied to a source of the transistor T31, a drain of the transistor T31 is connected to a drain of the transistor T32, and the corresponding clock signal CLK3 is supplied to a source of the transistor T32. A voltage at the node ECOUT_i on which the transistors T31 and T32 are connected to each other may be the light emitting control signal EC[i]. The light emitting control signal EC[i] may be supplied to the gate of the transistor T22, the gate of the transistor corresponding to the transistor T28 on the previous light emitting stage ESR_i−1, and the gate of the transistor T39 on the next light emitting stage ESR_i+1.

On the light emitting stage ESR_i+1, the corresponding gate signal S[i+1] is supplied to a source of the transistor T33, and a gate and the source of the transistor T33 are connected to each other. That is, the transistor T33 is diode-connected. A drain of the transistor T33 is connected to a drain of the transistor T34, and a node N9 on which the two transistors T33 and T34 are connected to each other is connected to gates of the two transistors T35 and T36. The light emitting control signal EC[i+1] is supplied to the gate of the transistor T36, and the voltage VSS is supplied to a source of the transistor T34. The voltage VBH is supplied to a source of the transistor T35, a drain of the transistor T35 is connected to a drain of the transistor T36, and the voltage VL is supplied to a source of the transistor T36. A node N10 on which the two transistors T35 and T36 are connected to each other is connected to gates of the two transistors T37 and T38. The voltage VSS is supplied to a source of the transistor T37, a drain of the transistor T37 is connected to a drain of the transistor T38, and the voltage VL is supplied to a source of the transistor T38. A node EOUT_i+1 on which the two transistors T37 and T38 are connected to each other is connected to the corresponding light emitting control line EMi+1. The light emitting signal E[i+1] may be supplied to a plurality of pixels PX of the corresponding pixel row through the light emitting control line EMi+1.

On the light emitting stage ESR_i+1, the pulse width of the light emitting signal E[i+1] may be controlled by the corresponding gate signal S[i+1] and the light emitting control signal EC[i+1]. The light emitting stage ESR_i+1 may include a light emitting control circuit EC_i+1 including six transistors T39 to T44 for generating the light emitting control signal EC[i+1].

On the light emitting control circuit EC_i+1, the previous light emitting control signal EC[i] generated by the previous light emitting stage ECR_i is supplied to a source of the transistor T39, and a gate and the source of the transistor T39 are connected to each other. That is, the transistor T39 is diode-connected. A drain of the transistor T39 is connected to a drain of the transistor T40, and a node N11 on which the two transistors T39 and T40 are connected to each other is connected to gates of the transistors T41 and T42. The next light emitting control signal EC[i+2] generated by the next light emitting stage ECR_i+2 is supplied to a gate of the transistor T40, and the voltage VSS is supplied to a source of the transistor T40. The voltage VBH is supplied to a source of the transistor T41, a drain of the transistor T41 is connected to a drain of the transistor T42, and the voltage VL is supplied to a source of the transistor T42. A node N12 on which the two transistors T41 and T42 are connected to each other is connected to gates of the two transistors T43 and T44. The voltage VSS is supplied to a source of the transistor T43, a drain of the transistor T43 is connected to a drain of the transistor T44, and the corresponding clock signal CLK4 is supplied to a source of the transistor T44. A voltage at a node on which the two transistors T43 and T44 are connected to each other may be the light emitting control signal EC[i+1]. The light emitting control signal EC[i+1] may be supplied to the gate of the transistor T34, the gate of the transistor T28 on the previous light emitting stage ESR_i, and a gate of a transistor corresponding to the transistor T39 on the next light emitting stage ESR_i+2.

An operation of the light emitting stage according to an embodiment will be described with reference to FIG. 21.

Figure 21:
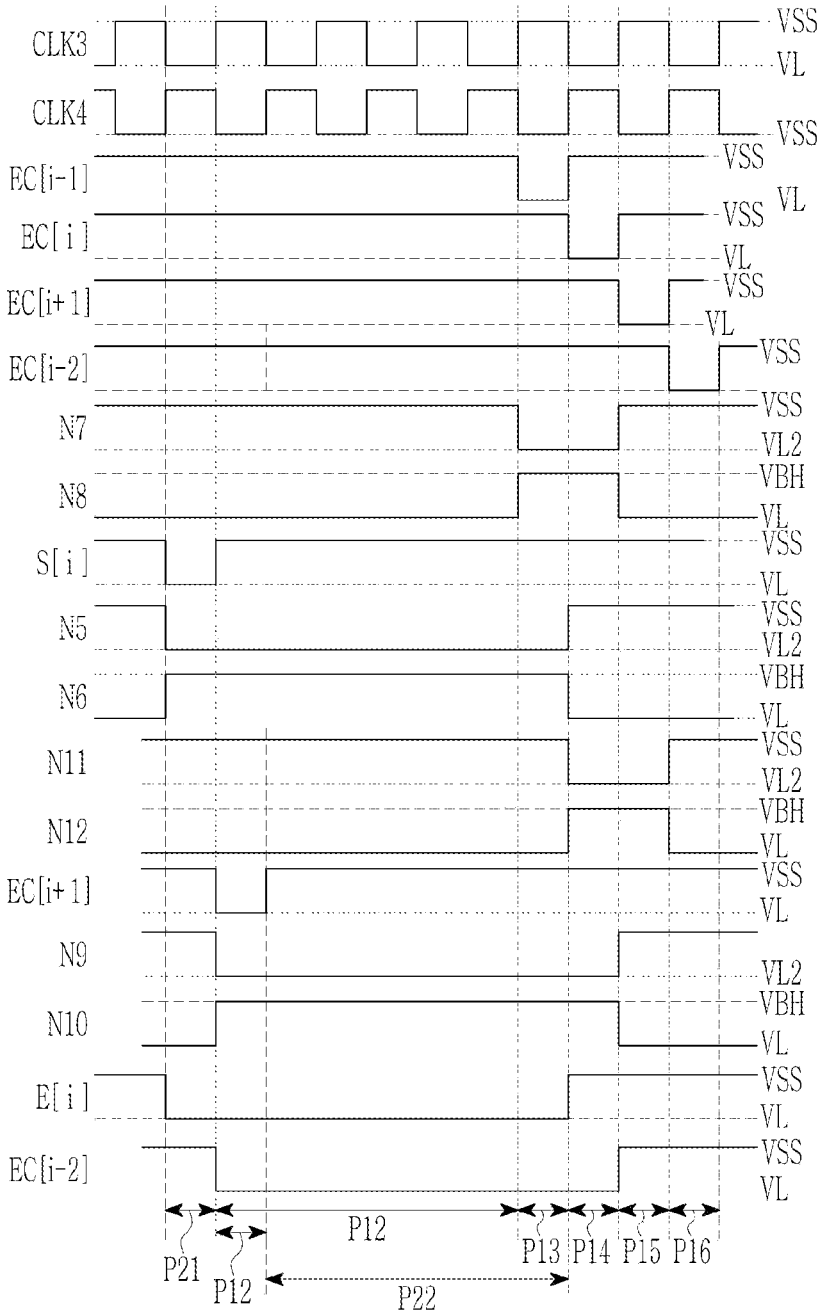
FIG. 21 shows a waveform diagram of clock signals, light emitting control signals, gate signals, and voltages at nodes, and light emitting signals according to an embodiment.

FIG. 21 shows a waveform diagram of clock signals, light emitting control signals, gate signals, and voltages at nodes, and light emitting signals according to an embodiment.

The clock signals CLK3 and CLK4 alternately have high-level voltages VSS and low-level voltages VL of which phases may be inverted from each other. The threshold voltages VTH of the transistors T21, T27, T33, and T39 may be negative voltages.

For a period P11, the gate signal S[i] is On-level. The transistor T21 is then turned on, and the voltage at the node N5 becomes the voltage VL-VTH of VL2 that is a subtraction of the threshold voltage VTH of the transistor T21 from the voltage VL of the gate signal S[i]. The voltage VL2 may be a low-level voltage for turning on the transistor T23. By the voltage VL2, the transistor T23 is turned on and the transistor T24 is turned off, and the voltage at the node N6 is charged with the voltage VBH. By the voltage VBH, the transistor T26 is turned on and the transistor T25 is turned off. The voltage VL is supplied as a light emitting signal E[i] to the light emitting control line Emi through the transistor T26 that is in the On state.

When the period P11 ends, the gate signal S[i] becomes the high-level voltage VSS and the transistor T21 is blocked. For a period P12, without bootstrapping, the voltage at the node N5 is maintained at the voltage VL2, the voltage at the node N6 is maintained at the voltage VBH, and the transistors T23 to T26 maintain the state of the period P11. For a period P12, the light emitting signal E[i] is maintained at the On-level voltage VL.

For a period P13, as the light emitting control signal EC[i−1] is On-level, the transistor T27 is turned on, and the voltage at the node N7 becomes the voltage VL-VTH of VL2 that is a subtraction of the threshold voltage VTH of the transistor T27 from the voltage VL of the light emitting control signal EC[i−1]. The voltage VL2 may be a low-level voltage for turning on the transistor T29. By the voltage VL2, the transistor T29 is turned on and the transistor T30 is turned off so the voltage at a node N8 is charged with the voltage VBH. By the voltage VBH, the transistor T32 is turned on and the transistor T31 is turned off. The clock signal CLK3 is supplied as the light emitting control signal EC[i] through the transistor T32 that is in the On state. For the period P13, as the clock signal CLK3 is the voltage VSS, the light emitting control signal EC[i] is maintained at the voltage VSS. As the transistor T22 is still in the Off state, for the period P13, the voltages at the node N5 and the node N6 and the light emitting signal E[i] maintain the state of the period P12.

When the period P13 ends, the light emitting control signal EC[i−1] becomes the high-level voltage VSS and the transistor T27 is blocked. For a period P14, without bootstrapping, the voltage at the node N7 is maintained at the voltage VL2, and the voltage at the node N8 is maintained at the voltage VBH so the transistors T29 to T32 maintain the state of the period P13. For the period P14, as the clock signal CLK3 is the low-level voltage VL, the light emitting control signal EC[i] is charged with the On-level voltage VL.

For the period P14, as the light emitting control signal EC[i] is On-level, the transistor T22 is in the On state. The voltage at the node N5 becomes the voltage VSS, and by the voltage VSS, the transistor T24 is turned on and the transistor T23 is turned off. The voltage at the node N6 is pulled down to the voltage VL through the transistor T24 that is in the On state. By the voltage VL, the transistor T25 is turned on and the transistor T26 is turned off. The light emitting signal E[i] is discharged to the voltage VSS through the transistor T25 that is in the On state.

For a period P15, as the light emitting control signal EC[i+1] is On-level, the transistor T28 is in the On state. The voltage at the node N7 becomes the voltage VSS, and by the voltage VSS, the transistor T30 is turned on and the transistor T29 is turned off. The voltage at the node N8 is pulled down to the voltage VL by the transistor T30 that is in the On state. By the voltage VL, the transistor T31 is turned on and the transistor T32 is turned off. The light emitting control signal EC[i] is discharged to the voltage VSS through the transistor T31 that is in the On state.

For a period P21, the gate signal S[i+1] is On-level. The transistor T33 is turned on, and the voltage at the node N9 becomes the voltage VL-VTH of VL2 that is a subtraction of the threshold voltage VTH of the transistor T33 from the voltage VL of the gate signal S[i+1]. The voltage VL2 may be a low-level voltage for turning on the transistor T35. By the voltage VL2, the transistor T35 is turned on and the transistor T36 is turned off so the voltage at the node N10 is charged with the voltage VBH. By the voltage VBH, the transistor T38 is turned on and the transistor T37 is turned off. The voltage VL is supplied as the light emitting signal E[i+1] to the light emitting control line EMi+1 through the transistor T38 that is in the On state.

When the period P21 ends, the gate signal S[i+1] becomes the high-level voltage VSS, and the transistor T33 is blocked. For a period P22, without bootstrapping, the voltage at the node N9 is maintained at the voltage VL2, and the voltage at the node N10 is maintained at the voltage VBH so the transistors T35 to T38 maintain the state of the period P21. For the period P22, the light emitting signal E[i+1] is maintained at the On-level voltage VL.

For the period P14, as the light emitting control signal EC[i] is On-level, the transistor T39 is turned on, and the voltage at the node N11 becomes the voltage VL-VTH of VL2 that is a subtraction of the threshold voltage VTH of the transistor T39 from the voltage VL of the light emitting control signal EC[i]. The voltage VL2 may be a low-level voltage for turning on the transistor T41. By the voltage VL2, the transistor T41 is turned on and the transistor T42 is turned off so the voltage at the node N12 is charged with the voltage VBH. By the voltage VBH, the transistor T44 is turned on and the transistor T43 is turned off. The clock signal CLK4 is supplied to the light emitting control signal EC[i+1] through the transistor T44 that is in the On state. For the period P14, as the clock signal CLK4 is the voltage VSS, the light emitting control signal EC[i+1] is maintained at the voltage VSS. As the transistor T34 is still in the Off state, for the period P14, the voltage at the nodes N9 and N10 and the light emitting signal E[i+1] maintain the period P22.

When the period P14 ends, the light emitting control signal EC[i] becomes the high-level voltage VSS and the transistor T39 is blocked. For the period P15, without bootstrapping, the voltage at the node N11 is maintained at the voltage VL2, and a voltage at a node N12 is maintained at the voltage VBH, so the transistors T41 to T44 maintain the state of the period P14. For the period P15, as the clock signal CLK4 is the low-level voltage VL, the light emitting control signal EC[i+1] is charged with the On-level voltage VL.

For the period P15, as the light emitting control signal EC[i+1] is On-level, the transistor T34 is in the On state. The voltage at the node N9 becomes the voltage VSS, and by the voltage VSS, the transistor T36 is turned on and the transistor T35 is turned off. The voltage at the node N10 is pulled down to the voltage VL through the transistor T36 that is in the On state. By the voltage VL, the transistor T37 is turned on and the transistor T38 is turned off. The light emitting signal E[i+1] is charged to the voltage VSS through the transistor T37 that is in the On state.

For a period P16, as the light emitting control signal EC[i+2] is On-level, the transistor T40 is in the On state. The voltage at the node N11 becomes the voltage VSS, and by the voltage VSS, the transistor T42 is turned on and the transistor T41 is turned off. The voltage at the node N12 is pulled down to the voltage VL through the transistor T42 that is in the On state. By the voltage VL, the transistor T43 is turned on and the transistor T44 is turned off. The light emitting control signal EC[i+1] is discharged to the voltage VSS through the transistor T43 that is in the On state.

Each time the gate signal S[i] becomes On-level in a next frame and the gate signal S[i+1] becomes On-level, the above-described operation may be repeated. According to the above-noted operation, for each frame, the light emitting stages ESR_1 to ESR_n may sequentially supply a plurality of On-level light emitting control signals E[1] to E[n] to the light emitting control lines EM1 to EMn.

As can be known from the waveform diagram shown in FIG. 21, On duties of the light emitting signals E[1] to E[n] are determined by an On pulse of the corresponding light emitting control signal. Therefore, the On duties of the light emitting signal may be adjusted without changing the pulse widths of the signals that are input to the light emitting driver 40. In detail, in one frame, the On duty of the light emitting signal E[1] may be determined according to the period between the On pulse of the gate signal S[1] and the On pulse of the light emitting control start signal ECSTR input to the light emitting stage ESR_1.

The effect described above with regard to the gate driver may be equivalently applied to the light emitting driver. This is because the light emitting driver 40 is realized with the LTPO TFT and no additional capacitor for bootstrapping is needed.

Figure 22A:
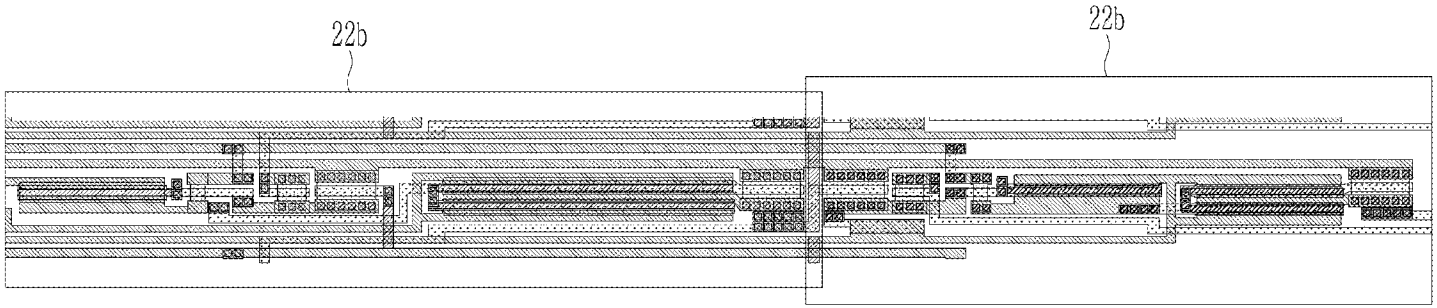
FIG. 22A shows a top plan view of a layout of an i-th light emitting stage shown in FIG. 20.

FIG. 22A shows a top plan view of a layout of an i-th light emitting stage shown in FIG. 20.

Referring to FIG. 22A, the light emitting control circuit EC_i may be positioned in a region 22*b*, and other components may be positioned in a region 22*c*.

Figure 22B:
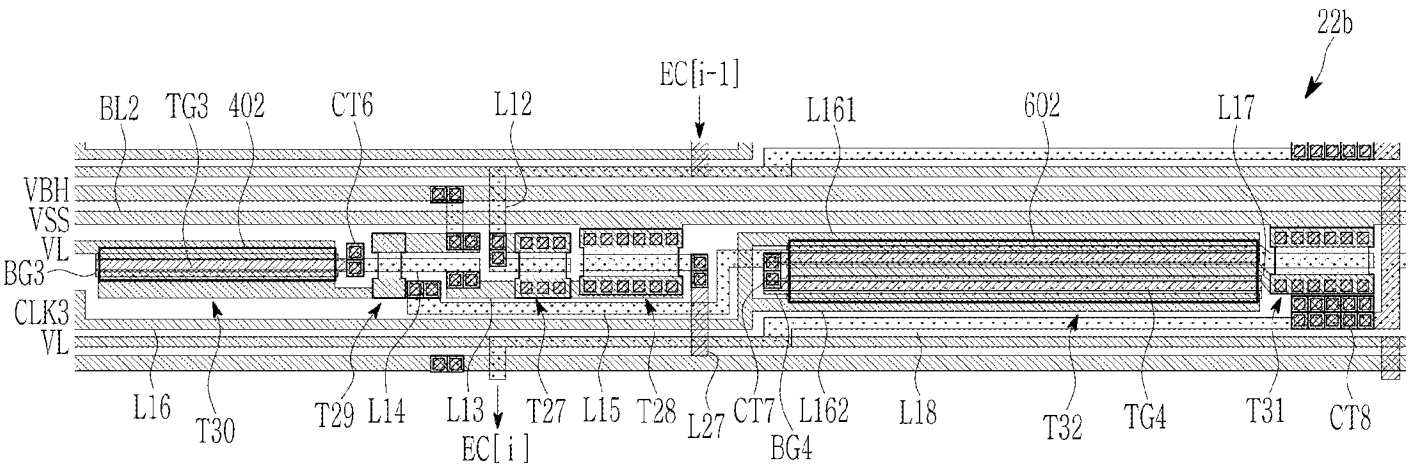
FIG. 22B shows a top plan view of a layout of a light emitting control circuit portion shown in FIG. 22A.

FIG. 22B shows a top plan view of a layout of a light emitting control circuit portion shown in FIG. 22A.

Figure 22C:
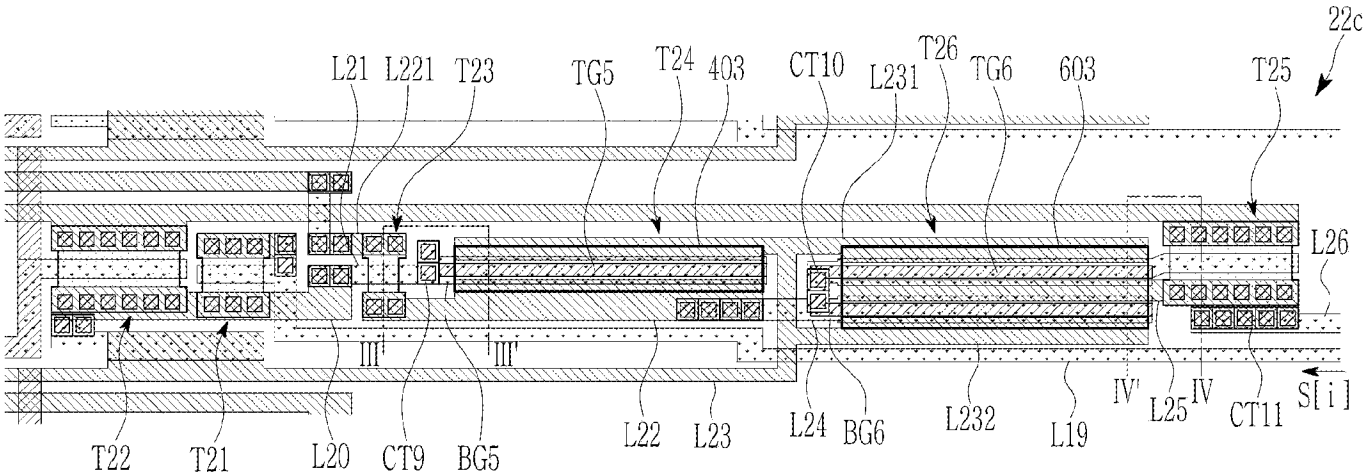
FIG. 22C shows a top plan view of a layout of a remaining portion excluding a portion shown in FIG. 22B from FIG. 22A.

FIG. 22C shows a top plan view of a layout of a remaining portion excluding a portion shown in FIG. 22B from FIG. 22A.

Figure 23:
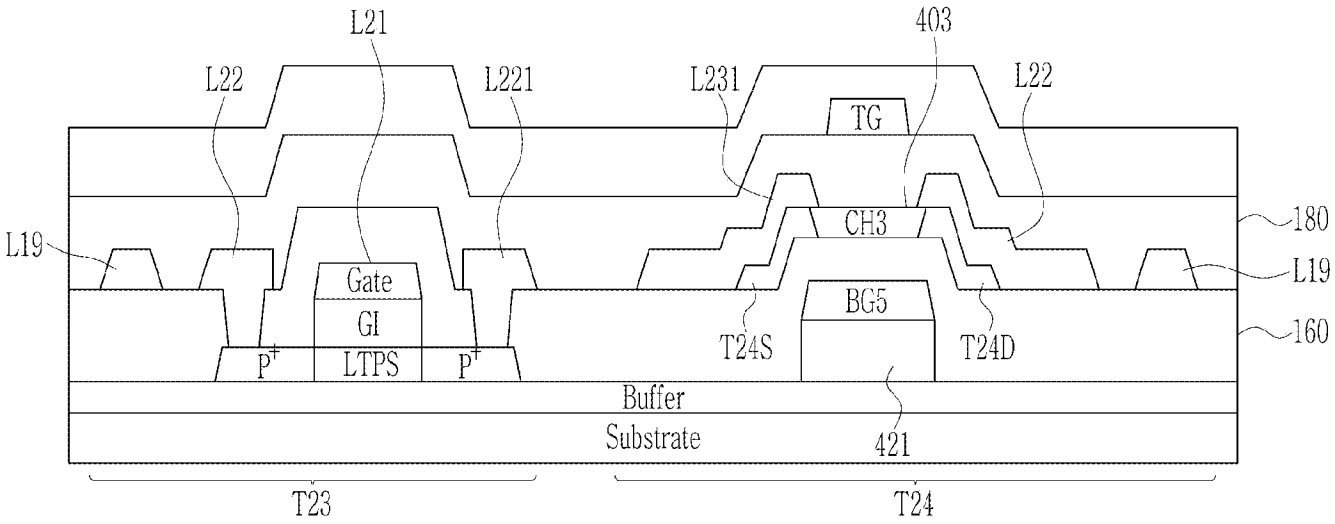
FIG. 23 shows a cross-sectional view with respect to a line III-III' in FIG. 22C.

FIG. 23 shows a cross-sectional view with respect to a line III-III' in FIG. 22C.

Figure 24:
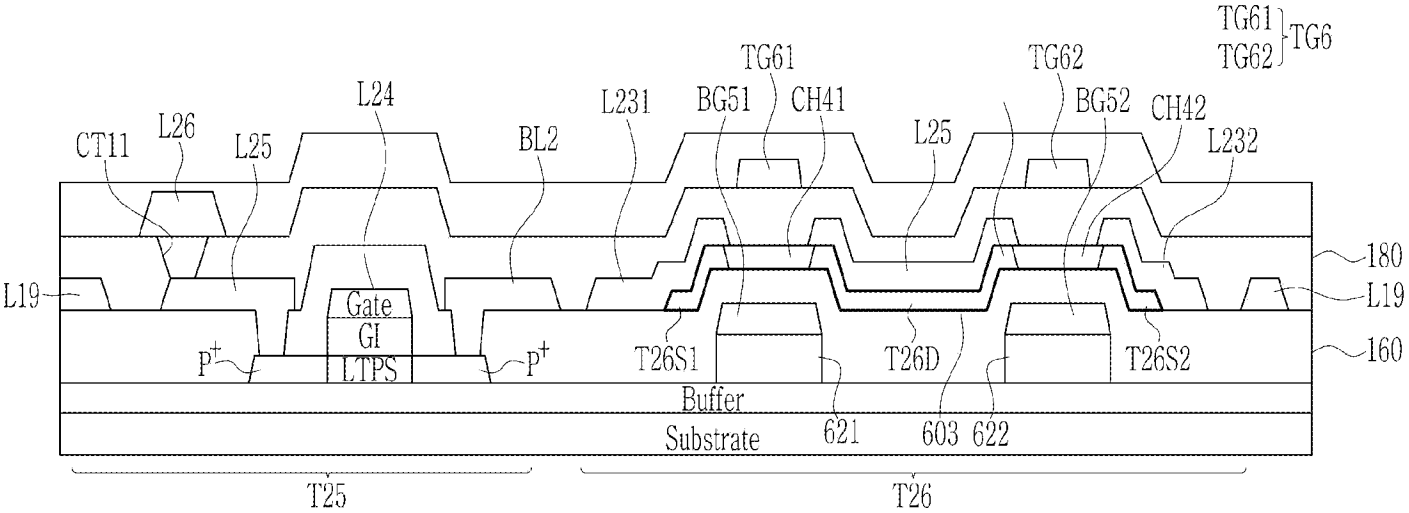
FIG. 24 shows a cross-sectional view with respect to a line IV-IV' in FIG. 22C.

FIG. 24 shows a cross-sectional view with respect to a line IV-IV' in FIG. 22C.

Referring to FIG. 22A to 22C, when a description on a predetermined layer is needed, a layout in which a certain layer covering the predetermined layer is removed may be shown. Referring to FIG. 22, semiconductor layers 402 and 403 realized with low-temperature polysilicon and semiconductor layers 602 and 603 realized with a-IGZO are marked with thick solid lines to be distinguished from other layers.

As shown in FIG. 22B, a drain of the transistor T27 is connected to a line L12 for transmitting the light emitting control signal EC[i−1], and a gate of the transistor T27 extends from the line L12. A source of the transistor T27 and a drain of the transistor T28 is connected to a line L13, a gate of the transistor T28 extends from a line L27 for transmitting the light emitting control signal EC[i+1], and a source of the transistor T28 is connected to a bus line BL2 for supplying the voltage VSS.

The line L13 is connected to the line L14 through a via contact. A gate of the transistor T29 and a bottom gate BG3 of the transistor T30 extend from the line L14. A top gate TG3 and the bottom gate BG3 of the transistor T30 are connected to each other through a via contact CT6. Drains of the transistor T29 and the transistor T30 are connected to a line L15. The voltage VL may be supplied to a source of the transistor T30, and the voltage VBH may be supplied to a source of the transistor T29.

A bottom gate BG4 of the transistor T32 includes a portion extending from the line L15 and a portion branched and extending, the bottom gate BG4 and a top gate TG4 of the transistor T32 are connected to each other through a via contact CT7, and a gate of the transistor T31 extends from the line L15. A source of the transistor T32 is connected to two lines L161 and L162, and the lines L161 and L162 may be branched from a line L16 and may extend. The clock signal CLK3 may be supplied to the line L16. A drain of the transistor T32 and a drain of the transistor T31 are connected to a line L17, and the line L17 is connected to a line L18 through a via contact CT8. The source of the transistor T31 is connected to the bus line BL2, and the voltage VSS is supplied to a source of the transistor T31.

The line L18 may extend to a gate of the transistor T22, and may be connected to a drain of the transistor T39 of the light emitting control circuit EC_i+1 on the next light emitting stage ESR_i+1.

As shown in FIG. 22C, the drain of the transistor T21 is connected to a line L19 for transmitting the corresponding gate signal S[i], and the gate of the transistor T21 extends from the line L19. A source of the transistor T21 and a drain of the transistor T22 are connected to a line L20, a gate of the transistor T22 extends from the line L18 for transmitting the light emitting control signal EC[i], and a source of the transistor T22 is connected to the bus line BL2 for supplying the voltage VSS.

The line L20 is connected to a line L21 through a via contact. A gate of the transistor T23 and a bottom gate BG5 of the transistor T24 extend from the line L21. A top gate TG5 and a bottom gate BG5 of the transistor T24 are connected to each other through a via contact CT9. Drains of the transistor T23 and the transistor T24 are connected to a line L22. The voltage VBH may be supplied to a source of the transistor T23. A source of the transistor T24 may be connected to a line L231, the line L231 may be branched from a line L23, and the voltage VL may be supplied to the line L23.

The line L24 is connected to the line L22 through a via contact. A bottom gate BG6 of the transistor T26 includes a portion extending from a line L24 and a portion branched and extending, the bottom gate BG6 is connected to the top gate TG6 of the transistor T26 through a via contact CT10, and the gate of the transistor T25 extends from the line L24. A source of the transistor T26 may be connected to the lines L231 and L232, and the lines L231 and L232 may be branched from the line L23 and may extend. A drain of the transistor T26 and a drain of the transistor T25 are connected to a line L25, and the line L25 is connected to a line L26 through a via contact CT11. A source of the transistor T25 is connected to the bus line BL2, and the voltage VSS is supplied to the source of the transistor T25. The line L26 may be connected to the light emitting control line EMi, and may extend as the light emitting control line EMi.

Cross-sectional structures of the transistors T29 and T30 may be similar to those of the transistors T23 and T24, and cross-sectional structures of the transistors 31 and 32 may be similar to those of the transistors T25 and T26. FIG. 23 shows cross-sectional structures of the transistors T23 and 24, and FIG. 24 shows cross-sectional structures of the transistors T25 and T26.

A cross-sectional structure of the transistors T23 and T44 configuring an inverter will now be described with reference to FIG. 24. The same portions as the cross-sectional structure described with reference to FIG. 2 will be omitted.

As shown in FIG. 23, the source and the drain (P+ region) of the transistor T23 are connected to the line L22 and the line L221, and the gate of the transistor T23 extends from the line L21. The voltage VBH may be supplied to the line L221.

A source region T24S of the a-IGZO layer 403 is connected to the line L61, and a drain region T24D of the a-IGZO layer 403 is connected to the line L22.

The bottom gate BG5 may be positioned on an insulation pattern 421 to correspond to a channel region CH31 of the a-IGZO layer 403, and the top gate TG5 may be positioned on an insulating layer 180 to correspond to the channel region CH31 of the a-IGZO layer 403.

A cross-sectional structure of the transistors T25 and T26 configuring an inverter will now be described with reference to FIG. 24. The same portions as the cross-sectional structure described with reference to FIG. 2 will be omitted.

As shown in FIG. 24, the source and the drain (P+ region) of the transistor T25 are connected to the bus line BL2 and the line L25, and the gate of the transistor T25 extends from the line L24.

Regarding the semiconductor layer of the transistor T26, the a-IGZO layer 603 is formed to have a single layer, and it may be realized into two a-IGZO layers as distinguished with dotted lines. Here, an insulating layer 180 may be positioned in a region between two adjacent dotted lines.

A source region T26S1 of the a-IGZO layer 603 may be connected to the line L231, a source region T26S2 of the a-IGZO layer 603 may be connected to the line L232, and a drain region T26D of the a-IGZO layer 603 may be connected to the line L25. The line L25 may be connected to the line L26 through the via contact CT11.

From among the two bottom gates BG61 and BG62, the bottom gate BG61 may be positioned on an insulation pattern 621 to correspond to a channel region CH41 of the a-IGZO layer 603, and the bottom gate BG62 may be positioned on an insulation pattern 622 to correspond to a channel region CH42 of the a-IGZO layer 603. A passivation layer 160 may be positioned between the a-IGZO layer 603 and the two bottom gates BG61 and BG62.

From among two top gates TG61 and TG62, the top gate TG61 may be positioned on the insulating layer 180 to correspond to the channel region CH41 of the a-IGZO layer 603, and the top gate TG62 may be positioned on the insulating layer 180 to correspond to the channel region CH42 of the a-IGZO layer 603.

Figure 25:
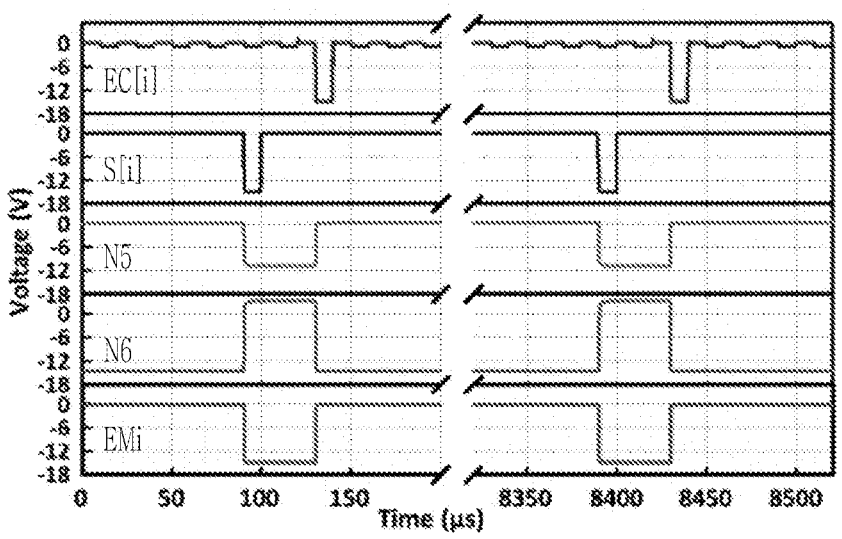
FIG. 25 shows a waveform diagram of signals generated when an operation of a light emitting driver according to an embodiment is simulated.

FIG. 25 shows a waveform diagram of signals generated when an operation of a light emitting driver according to an embodiment is simulated.

In this instance, widths of the transistors T23 and T29, the transistors T21 and T27, the transistors T22, T28, and T31, the transistor T25, the transistors T24 and T30, the transistor T26, and the transistor T32 may be 10 μm, 20 μm, 40 μm, 50 μm, 100 μm, 200 μm, and 400 μm. The clock signal CLK3 may swing between 0 V and −15 V, the VSS may be 0 V, and the threshold voltage Vth of the a-IGZO TFT may be −5.5 V, VL may be −15 V, and VBH may be 6 V. When the threshold voltage of the a-IGZO TFT is a negative voltage, so when the voltage at the node N8 is the voltage VL, the transistor T32 may not be completely turned off. The light emitting control signal EC[i] has ripples according to an incomplete Off state of the transistor T32. However, as a ripple voltage of the light emitting control signal EC[i] is insufficient in turning on the transistors T21 and T22, the transistor T21 is turned on by the gate signal S[i], and the voltages at the node N5 and the node N6 are not influenced by the ripples. Accordingly, the light emitting signal E[i] may have an excellent waveform without degradation. That is, when the threshold voltage Vth of the a-IGZO TFT is a negative voltage, the light emitting driver 40 may generate a light emitting signal having a waveform that is appropriate to drive the display without ripples.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

1: display
10: display unit
20: gate driver
30: data driver
40: light emitting driver
50: power supply
60: controller
100: complementary transistor
200: first transistor
300: second transistor

What is claimed is:

1. A driving circuit including a plurality of stages for supplying a plurality of signals, wherein the respective stages include:

a first LTPO transistor including a first transistor that is a low-temperature polycrystalline silicon thin film transistor (LTPS TFT) and a second transistor that is an oxide TFT; and a second LTPO transistor including a third transistor that is an LTPS TFT and a fourth transistor that is an oxide TFT, and a first end of the first LTPO transistor is connected to a gate of the second LTPO transistor, and voltages of signals corresponding to the respective stages from among the signals are a voltage at a first end of the second LTPO transistor, wherein a first end of the third transistor and a first end of the fourth transistor are connected to a first end of the second LTPO transistor, and a first voltage is supplied to a second end of the third transistor, while a clock signal is supplied to a second end of the fourth transistor.

2. The driving circuit of claim 1, wherein the respective stages further include:

a fifth transistor operable by a previous signal output from a previous stage of the respective stages; and a sixth transistor operable by a next signal output from a next stage of the respective stages, and the previous signal is supplied to a gate and a first end of the fifth transistor, the next signal is supplied to a gate of the sixth transistor, and a second end of the fifth transistor and a first end of the sixth transistor are connected to a gate of the first LTPO transistor.

3. The driving circuit of claim 1, wherein a first end of the first transistor and a first end of the second transistor are connected to a first end of the first LTPO transistor, and a second voltage is supplied to a second end of the first transistor, while a third voltage is supplied to a second end of the second transistor.

4. The driving circuit of claim 1, wherein the respective stages further include: a control circuit including a third LTPO transistor including a fifth transistor that is an LTPS TFT and a sixth transistor that is an oxide TFT; and a fourth LTPO transistor including a seventh transistor that is an LTPS TFT and an eighth transistor that is an oxide TFT, and a first end of the third LTPO transistor is connected to a gate of the fourth LTPO transistor, a voltage at a first end of the fourth LTPO is a voltage of a control signal that is an output of the control circuit, and the first LTPO transistor is operated according to the control signal.

5. The driving circuit of claim 4, wherein the control circuit of the respective stages further includes:

a ninth transistor operable by a previous control signal output from a control circuit of a previous stage of the respective stages; and a tenth transistor operable by a next control signal output from a control circuit of a next stage of the respective stages, and the previous control signal is supplied to a gate and a first end of the ninth transistor, the next control signal is supplied to a gate of the tenth transistor, and a second end of the ninth transistor and a first end of the tenth transistor are connected to a gate of the third LTPO transistor.

6. The driving circuit of claim 4, wherein a first end of the seventh transistor and a first end of the eighth transistor are connected to a first end of the fourth LTPO transistor, and a first voltage is supplied to a second end of the seventh transistor, while a clock signal is supplied to a second end of the eighth transistor.

7. The driving circuit of claim 6, wherein a first end of the fifth transistor and a first end of the sixth transistor are connected to the first end of the third LTPO transistor, and a second voltage is supplied to a second end of the fifth transistor, while a third voltage is supplied to a second end of the sixth transistor.

8. The driving circuit of claim 4, wherein the respective stages further include:

a ninth transistor operable by a corresponding one of a plurality of other signals corresponding to the signals; and a tenth transistor operable by the control signal, and the corresponding other signal is supplied to a gate and a first end of the ninth transistor, the control signal is supplied to a gate of the tenth transistor, and a second end of the ninth transistor and a first end of the tenth transistor are connected to a gate of the first LTPO transistor.

9. The driving circuit of claim 4, wherein a first end of the seventh transistor and a first end of the eighth transistor are connected to a first end of the second LTPO transistor, and a first voltage is supplied to a second end of the seventh transistor, while a second voltage is supplied to a second end of the eighth transistor.

10. The driving circuit of claim 9, wherein a first end of the fifth transistor and a first end of the sixth transistor are connected to a first end of the first LTPO transistor, and a third voltage is supplied to a second end of the fifth transistor, while the second voltage is supplied to a second end of the sixth transistor.

11. The driving circuit of claim 1, wherein a gate of the first transistor and a bottom gate of the second transistor extend from one line, and a top gate of the second transistor is connected to the bottom gate through a via contact.

12. The driving circuit of claim 1, wherein a gate of the third transistor and a bottom gate of the fourth transistor are branched from one line, and a top gate of the second transistor is connected to the bottom gate through a via contact.

13. A display comprising:

a plurality of pixel rows including a plurality of pixels; and a gate driver including a plurality of stages for generating a plurality of gate signals and supplying the same to the pixel rows, wherein the respective stages include a first LTPO transistor realized with a first transistor that is a low-temperature polycrystalline silicon thin film transistor (LTPS TFT) and a second transistor that is an oxide TFT, the second transistor is synchronized with an On-pulse of a corresponding previous gate signal and outputs a corresponding clock signal as the gate signal, and the first transistor is synchronized with an On-pulse of a corresponding next gate signal and outputs an Off-level gate signal, and wherein the respective stages further include a second LTPO transistor realized with a third transistor that is an LTPS TFT and a fourth transistor that is an oxide TFT, the third transistor is synchronized with an On-pulse of the previous gate signal and turns on the second transistor, and the fourth transistor is synchronized with an On-pulse of the corresponding next gate signal and turns on the first transistor.

14. The display of claim 13, further comprising a light emitting driver including a plurality of light emitting stages for generating a plurality of light emitting signals and supplying the same to the pixel rows, wherein the respective light emitting stages include a second LTPO transistor realized with a third transistor that is an LTPS TFT and a fourth transistor that is an oxide TFT, the fourth transistor is synchronized with an On-pulse of a corresponding gate signal and outputs an On-level light emitting signal, and the third transistor is synchronized with an On-pulse of a light emitting control signal and outputs an Off-level light emitting signal.

15. The display of claim 14, wherein the respective light emitting stages further include a third LTPO transistor realized with a fifth transistor that is an LTPS TFT and a sixth transistor that is an oxide TFT, the fifth transistor is synchronized with an On-pulse of the corresponding gate signal and turns on the fourth transistor, and the sixth transistor is synchronized with an On-pulse of the light emitting control signal and turns on the third transistor.

16. The display of claim 14, wherein the respective light emitting stages further include a light emitting control circuit for generating the light emitting control signal, the light emitting control circuit includes:

a fourth LTPO transistor including a fifth transistor that is an LTPS TFT and a sixth transistor that is an oxide TFT; and a fifth LTPO transistor including a seventh transistor that is an LTPS TFT and an eighth transistor that is an oxide TFT, and a first end of the fourth LTPO transistor is connected to a gate of the fifth LTPO transistor, while a voltage at a first end of the fifth LTPO is a voltage of the control signal.

17. A driving circuit including a plurality of stages for supplying a plurality of signals, wherein the respective stages include:

a first LTPO transistor including a first transistor that is a low-temperature polycrystalline silicon thin film transistor (LTPS TFT) and a second transistor that is an oxide TFT;

a second LTPO transistor including a third transistor that is an LTPS TFT and a fourth transistor that is an oxide TFT;

a fifth transistor operable by a previous signal output from a previous stage of the respective stages; and a sixth transistor operable by a next signal output from a next stage of the respective stages, and wherein a first end of the first LTPO transistor is connected to a gate of the second LTPO transistor, voltages of signals corresponding to the respective stages from among the signals are a voltage at a first end of the second LTPO transistor, the previous signal is supplied to a gate and a first end of the fifth transistor, the next signal is supplied to a gate of the sixth transistor, and a second end of the fifth transistor and a first end of the sixth transistor are connected to a gate of the first LTPO transistor.

* * * * *